US009282859B2

(12) United States Patent
Dyson et al.

(10) Patent No.: US 9,282,859 B2
(45) Date of Patent: Mar. 15, 2016

(54) CANISTER VACUUM CLEANER

(71) Applicant: Dyson Technology Limited, Wiltshire (GB)

(72) Inventors: James Dyson, Bristol (GB); Peter David Gammack, Swindon (GB); David Robert Sunderland, Bristol (GB); Stuart Lloyd Genn, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 14/663,035

(22) Filed: Mar. 19, 2015

(65) Prior Publication Data

US 2015/0190022 A1 Jul. 9, 2015

Related U.S. Application Data

(63) Continuation of application No. 14/081,652, filed on Nov. 15, 2013, now Pat. No. 8,991,001, which is a continuation of application No. 12/730,428, filed on Mar. 24, 2010, now Pat. No. 8,695,155.

(30) Foreign Application Priority Data

Mar. 31, 2009 (GB) ..... 0905486.7

(51) Int. Cl.

| | |
|---|---|
| ***A47L 5/00*** | (2006.01) |
| ***A47L 9/00*** | (2006.01) |
| ***A47L 5/36*** | (2006.01) |
| ***A47L 9/12*** | (2006.01) |

(Continued)

(52) U.S. Cl.

CPC ..... *A47L 5/362* (2013.01); *A47L 9/009* (2013.01); *A47L 9/0081* (2013.01); *A47L 9/127* (2013.01); *A47L 9/1633* (2013.01); *A47L 9/1641* (2013.01); *A47L 9/22* (2013.01); *A47L 9/24* (2013.01); *A47L 9/327* (2013.01)

(58) Field of Classification Search

CPC ..... A47L 5/362; A47L 9/1633; A47L 9/1641; A47L 9/22; A47L 9/327; A47L 9/009

See application file for complete search history.

(56) References Cited

U.S. PATENT DOCUMENTS

| | | | |
|---|---|---|---|
| 963,139 | A | 7/1910 | Griffiths |
| 1,123,839 | A | 1/1915 | Bridges |

(Continued)

FOREIGN PATENT DOCUMENTS

| | | |
|---|---|---|
| CN | 1050981 | 5/1991 |
| CN | 1310979 | 9/2001 |

(Continued)

OTHER PUBLICATIONS

GB Search Report dated Jul. 10, 2009, directed at counterpart GB Application No. 0905486.7; 1 page.

(Continued)

*Primary Examiner* — Brian Mattei

(74) *Attorney, Agent, or Firm* — Morrison & Foerster LLP

(57) ABSTRACT

A cleaning appliance of the canister type includes separating apparatus for separating dirt from a dirt-bearing fluid flow, a floor engaging rolling assembly, and a steering mechanism for steering the cleaning appliance as it is maneuvered over a floor surface and for pivoting the separating apparatus relative to the rolling assembly.

30 Claims, 26 Drawing Sheets

(51) Int. Cl.

| | |
|---|---|
| ***A47L 9/16*** | (2006.01) |
| ***A47L 9/22*** | (2006.01) |
| ***A47L 9/24*** | (2006.01) |
| ***A47L 9/32*** | (2006.01) |

(56) References Cited

U.S. PATENT DOCUMENTS

| | | | | |
|---|---|---|---|---|
| 1,301,453 | A | 4/1919 | Kendall | |
| 1,605,507 | A | 11/1926 | Burke | |
| 1,861,402 | A | 5/1932 | Riper | |
| 1,918,713 | A | 7/1933 | Ponselle | |
| 2,125,850 | A | 8/1938 | Norris | |
| RE22,426 | E | 1/1944 | Smellie | |
| 2,352,504 | A | 6/1944 | White | |
| 2,489,100 | A | 11/1949 | Marco | |
| 2,686,330 | A | 8/1954 | Wales | |
| 2,699,838 | A | 1/1955 | Holm-Hansen | |
| 2,738,538 | A | 3/1956 | Vance | |
| 2,747,216 | A | 5/1956 | Tschudy | |
| 2,771,309 | A | 11/1956 | Clark, Jr. | |
| 2,834,605 | A | 5/1958 | McCollough | |
| 2,876,479 | A | 3/1959 | Kaufman | |
| 2,954,802 | A | 10/1960 | Duff | |
| 3,038,743 | A | 6/1962 | Zaloumis | |
| 3,375,541 | A | 4/1968 | Fromknecht | |
| 3,378,877 | A | 4/1968 | Boerrefors | |
| 3,524,211 | A | 8/1970 | Wolf | |
| 3,524,212 | A | 8/1970 | Spencer | |
| 3,608,333 | A | 9/1971 | Selley et al. | |
| 4,059,296 | A | 11/1977 | Panourgias | |
| 4,114,231 | A | 9/1978 | Nauta | |
| 4,486,037 | A | 12/1984 | Shotbolt | |
| 4,573,236 | A | 3/1986 | Dyson | |
| 5,134,749 | A | 8/1992 | Sakurai et al. | |
| 5,144,716 | A | 9/1992 | Watanabe et al. | |
| 5,149,147 | A | 9/1992 | Kastrup et al. | |
| 5,214,822 | A * | 6/1993 | Sakurai et al. | 15/325 |
| 5,275,444 | A | 1/1994 | Wythoff | |
| 5,353,470 | A | 10/1994 | Bartlett | |
| 5,467,500 | A | 11/1995 | O'Hara et al. | |
| 5,784,757 | A | 7/1998 | Cipolla | |
| 5,815,881 | A | 10/1998 | Sjögreen | |
| 5,839,156 | A | 11/1998 | Park et al. | |
| 5,857,240 | A | 1/1999 | Park et al. | |
| 5,937,477 | A | 8/1999 | Dyson | |
| 5,954,370 | A | 9/1999 | Pietersen | |
| 6,058,559 | A | 5/2000 | Yoshimi et al. | |
| 6,079,690 | A | 6/2000 | Yoon | |
| 6,141,822 | A | 11/2000 | Riviera-Boklund et al. | |
| 6,154,921 | A | 12/2000 | Green et al. | |
| 6,158,781 | A | 12/2000 | Aaron, III | |
| 6,256,834 | B1 * | 7/2001 | Meijer et al. | 15/352 |
| 6,317,921 | B1 | 11/2001 | Park et al. | |
| 6,345,408 | B1 | 2/2002 | Nagai et al. | |
| 6,371,421 | B1 | 4/2002 | Ma et al. | |
| 6,474,696 | B1 | 11/2002 | Canale | |
| 6,482,246 | B1 | 11/2002 | Dyson et al. | |
| 6,484,350 | B2 | 11/2002 | Yung | |
| 6,536,073 | B2 | 3/2003 | Uratani et al. | |
| 6,712,868 | B2 | 3/2004 | Murphy et al. | |
| 6,928,690 | B2 | 8/2005 | Ji | |
| 7,181,804 | B2 | 2/2007 | Hafling et al. | |
| 7,185,389 | B2 | 3/2007 | Thomason et al. | |
| 7,380,308 | B2 | 6/2008 | Oh et al. | |
| 7,425,225 | B2 | 9/2008 | Genn et al. | |
| D591,016 | S | 4/2009 | Dyson et al. | |
| 8,020,251 | B2 | 9/2011 | Luebbering et al. | |
| 8,079,113 | B2 | 12/2011 | Chong et al. | |
| 8,117,713 | B2 | 2/2012 | Kasper et al. | |
| 8,359,705 | B2 | 1/2013 | Conrad | |
| 8,434,193 | B2 | 5/2013 | Sunderland et al. | |
| 8,474,091 | B2 | 7/2013 | Dyson et al. | |
| 8,695,155 | B2 | 4/2014 | Dyson et al. | |
| 2001/0029641 | A1 | 10/2001 | Uratani et al. | |
| 2001/0054213 | A1 * | 12/2001 | Oh et al. | 15/353 |
| 2002/0063427 | A1 | 5/2002 | Schiemann et al. | |
| 2004/0045121 | A1 | 3/2004 | Kim | |
| 2004/0074213 | A1 | 4/2004 | Organ | |
| 2004/0088816 | A1 | 5/2004 | Shimizu et al. | |
| 2004/0112019 | A1 | 6/2004 | Mountford | |
| 2004/0226130 | A1 | 11/2004 | Oh et al. | |
| 2005/0039297 | A1 | 2/2005 | Morgan et al. | |
| 2005/0066635 | A1 | 3/2005 | Genn et al. | |
| 2005/0108849 | A1 | 5/2005 | Lam | |
| 2005/0198764 | A1 | 9/2005 | Heatley | |
| 2005/0223517 | A1 | 10/2005 | Courtney | |
| 2005/0235454 | A1 | 10/2005 | Courtney | |
| 2006/0101610 | A1 | 5/2006 | Oh et al. | |
| 2006/0131876 | A1 | 6/2006 | Knowles et al. | |
| 2006/0213023 | A1 | 9/2006 | Hare et al. | |
| 2007/0039118 | A1 | 2/2007 | Choi | |
| 2007/0067945 | A1 | 3/2007 | Kasper et al. | |
| 2007/0094840 | A1 | 5/2007 | Zahuranec et al. | |
| 2007/0157416 | A1 * | 7/2007 | Lee et al. | 15/319 |
| 2008/0104793 | A1 * | 5/2008 | Kang et al. | 15/327.5 |
| 2008/0178410 | A1 * | 7/2008 | Salmon | 15/300.1 |
| 2008/0196196 | A1 | 8/2008 | Conrad | |
| 2008/0263814 | A1 | 10/2008 | Bassett et al. | |
| 2008/0282497 | A1 | 11/2008 | Griffith et al. | |
| 2008/0289140 | A1 | 11/2008 | Courtney et al. | |
| 2009/0007370 | A1 | 1/2009 | Gomiciaga-Pereda et al. | |
| 2009/0100634 | A1 | 4/2009 | Bates et al. | |
| 2009/0144928 | A1 | 6/2009 | Yoo | |
| 2010/0132149 | A1 * | 6/2010 | Jeong et al. | 15/319 |
| 2010/0139030 | A1 * | 6/2010 | Yoo | 15/328 |
| 2010/0154367 | A1 * | 6/2010 | Luo et al. | 55/337 |
| 2010/0242208 | A1 | 9/2010 | Gammack et al. | |
| 2010/0242211 | A1 | 9/2010 | Sunderland et al. | |
| 2010/0242212 | A1 | 9/2010 | Dyson et al. | |
| 2010/0242213 | A1 | 9/2010 | Sunderland et al. | |
| 2010/0242214 | A1 | 9/2010 | Sunderland et al. | |
| 2010/0242216 | A1 | 9/2010 | MacNaughton | |
| 2010/0242217 | A1 | 9/2010 | Sunderland et al. | |
| 2010/0242218 | A1 | 9/2010 | Genn et al. | |
| 2010/0242219 | A1 | 9/2010 | Dyson et al. | |
| 2010/0242220 | A1 | 9/2010 | Dyson et al. | |
| 2011/0088196 | A1 | 4/2011 | Wills et al. | |
| 2012/0079673 | A1 | 4/2012 | Wishney et al. | |
| 2012/0079674 | A1 | 4/2012 | Dyson et al. | |
| 2012/0079676 | A1 | 4/2012 | Sunderland | |
| 2012/0079677 | A1 | 4/2012 | Dyson et al. | |
| 2014/0075715 | A1 | 3/2014 | MacNaughton | |

FOREIGN PATENT DOCUMENTS

| | | |
|---|---|---|
| CN | 1337204 | 2/2002 |
| CN | 1428122 | 7/2003 |
| CN | 1593322 | 3/2005 |
| CN | 2764289 | 3/2006 |
| CN | 1794941 | 6/2006 |
| CN | 101262807 | 9/2008 |
| DE | 36 17 681 | 12/1987 |
| DE | 299 13 775 | 2/2000 |
| DE | 10 2006 008 556 | 8/2007 |
| EP | 0 558 101 | 9/1993 |
| EP | 0 734 678 | 10/1996 |
| EP | 1 129 657 | 9/2001 |
| EP | 1 210 899 | 6/2002 |
| EP | 1 457 150 | 9/2004 |
| EP | 1493373 | 1/2005 |
| EP | 1 474 026 | 11/2005 |
| EP | 1 669 015 | 6/2006 |
| EP | 1 836 941 | 9/2007 |
| EP | 1 857 032 | 11/2007 |
| EP | 1 915 937 | 4/2008 |
| FR | 1.310.618 | 11/1962 |
| FR | 2 833 826 | 6/2003 |
| GB | 645847 | 11/1950 |
| GB | 2 290 462 | 1/1996 |
| GB | 2368516 | 5/2002 |
| GB | 2 391 459 | 2/2004 |
| GB | 2407022 | 4/2005 |
| GB | 2 402 046 | 9/2006 |
| GB | 2 433 425 | 6/2007 |

(56) References Cited

FOREIGN PATENT DOCUMENTS

| | | |
|---|---|---|
| GB | 2 452 549 | 3/2009 |
| GB | 2453995 | 4/2009 |
| GB | 2469038 | 10/2010 |
| GB | 2469039 | 10/2010 |
| GB | 2469045 | 10/2010 |
| GB | 2469046 | 10/2010 |
| GB | 2469047 | 10/2010 |
| GB | 2469052 | 10/2010 |
| GB | 2469055 | 10/2010 |
| GB | 2475765 | 6/2011 |
| GB | 2484121 | 4/2012 |
| JP | 2-107218 | 4/1990 |
| JP | 3-30 | 1/1991 |
| JP | 4-103851 | 9/1992 |
| JP | 5-91956 | 4/1993 |
| JP | 5-168577 | 7/1993 |
| JP | 7-163489 | 6/1995 |
| JP | 7-184809 | 7/1995 |
| JP | 8-275909 | 10/1996 |
| JP | 8-317883 | 12/1996 |
| JP | 9-276189 | 10/1997 |
| JP | 10-278835 | 10/1998 |
| JP | 2001-504001 | 3/2001 |
| JP | 2001-314356 | 11/2001 |
| JP | 2002-528250 | 9/2002 |
| JP | 2002-345693 | 12/2002 |
| JP | 2002-355199 | 12/2002 |
| JP | 2003-24249 | 1/2003 |
| JP | 2003-211025 | 7/2003 |
| JP | 2003-310491 | 11/2003 |
| JP | 2003-325392 | 11/2003 |
| JP | 2004-310385 | 11/2004 |
| JP | 2005-516712 | 6/2005 |
| JP | 2005-334450 | 12/2005 |
| JP | 2006-524062 | 10/2006 |
| JP | 2006-326186 | 12/2006 |
| JP | 2007-520294 | 7/2007 |
| JP | 2007-307352 | 11/2007 |
| JP | 2008-43635 | 2/2008 |
| JP | 2008-125867 | 6/2008 |
| JP | 2009-22403 | 2/2009 |
| JP | 2009-50735 | 3/2009 |
| NL | 6711520 | 2/1969 |
| WO | WO-00/24519 | 5/2000 |
| WO | WO-01/56449 | 8/2001 |
| WO | WO-03/034888 | 5/2003 |
| WO | WO-03/039316 | 5/2003 |
| WO | WO-03/068042 | 8/2003 |
| WO | WO-2008/090490 | 7/2008 |
| WO | WO-2008/117945 | 10/2008 |
| WO | WO-2009/011482 | 1/2009 |
| WO | WO-2009/022759 | 2/2009 |
| WO | WO-2009/030885 | 3/2009 |
| WO | WO-2010/112887 | 10/2010 |
| WO | WO-2011/072388 | 6/2011 |

OTHER PUBLICATIONS

EP Search Report dated Apr. 14, 2015, directed to EP Application No. 14 16 6740; 5 pages.
International Search Report and Written Opinion mailed Jun. 24, 2010, directed to PCT/GB2010/050411; 15 pages.
Dyson et al., U.S. Office Action mailed Sep. 6, 2012, directed to U.S. Appl. No. 12/730,428; 12 pages.
Dyson et al., U.S. Office Action mailed Jan. 2, 2013, directed to U.S. Appl. No. 12/730,428; 11 pages.
Dyson et al., U.S. Office Action mailed Jun. 10, 2013, directed to U.S. Appl. No. 12/730,428; 7 pages.
Dyson et al., U.S. Office Action mailed Dec. 23, 2013, directed to U.S. Appl. No. 14/081,652; 7 pages.
Dyson et al., U.S. Office Action mailed Jul. 23, 2014, directed to U.S. Appl. No. 14/081,652; 10 pages.
Dyson et al, U.S. Office Action mailed Apr. 24, 2012, directed to U.S. Appl. No. 12/731,967; 19 pages.
Dyson et al., U.S. Office Action mailed Aug. 8, 2012, directed to U.S. Appl. No. 12/731,967; 14 pages.
Dyson et al., U.S. Office Action mailed Jan. 28, 2013, directed to U.S. Appl. No. 12/731,967; 14 pages.
Gammack et al., U.S. Office Action mailed Dec. 7, 2012, directed to U.S. Appl. No. 12/731,755; 11 pages.
Gammack et al., U.S. Office Action mailed Mar. 14, 2013, directed to U.S. Appl. No. 13/731,755; 9 pages.
Dyson et al., U.S. Office Action mailed Sep. 27, 2012, directed to U.S. Appl. No. 12/729,751; 19 pages.
Dyson et al., U.S. Office Action mailed Apr. 8, 2013, directed to U.S. Appl. No. 12/729,751; 20 pages.
Dyson et al., U.S. Office Action mailed Sep. 11, 2013, directed to U.S. Appl. No. 12/729,751; 16 pages.
Sunderland et al., U.S. Office Action mailed Sep. 27, 2012, directed to U.S. Appl. No. 12/729,885; 20 pages.
Sunderland et al., U.S. Office Action mailed Apr. 3, 2013, directed to U.S. Appl. No. 12/729,885; 10 pages.
Sunderland et al., U.S. Office Action mailed Apr. 25, 2012, directed to U.S. Appl. No. 12/729,849; 22 pages.
Sunderland et al., U.S. Office Action mailed Aug. 24, 2012, directed to U.S. Appl. No. 12/729,849; 18 pages.
Sunderland et al., U.S. Office Action mailed Sep. 13, 2012, directed to U.S. Appl. No. 12/729,643; 11 pages.
Sunderland et al., U.S. Office Action mailed Feb. 12, 2013, directed to U.S. Appl. No. 12/729,643; 8 pages.
Sunderland et al., U.S. Office Action mailed Jun. 20, 2013, directed to U.S. Appl. No. 12/729,643; 7 pages.
MacNaughton, Roy, U.S. Office Action mailed Feb. 14, 2013, directed to U.S. Appl. No. 12/730,539; 9 pages.
MacNaughton, Roy, U.S. Office Action mailed Sep. 13, 2012, directed to U.S. Appl. No. 12/730,539; 9 pages.
MacNaughton, U.S. Office Action mailed Jun. 19, 2013, directed to U.S. Appl. No. 12/730,539; 11 pages.
MacNaughton, U.S. Office Action mailed Sep. 22, 2014, directed to U.S. Appl. No. 14/082,903; 10 pages.
Genn et al., U.S. Office Action mailed Sep. 13, 2012, directed to U.S. Appl. No. 12/730,900; 12 pages.
Genn et al., U.S. Office Action mailed Jan. 15, 2013, directed to U.S. Appl. No. 12/730,900; 8 pages.
Genn et al., U.S. Office Action mailed Jul. 30, 2013, directed to U.S. Appl. No. 12/730,900; 5 pages.
Dyson et al., U.S. Office Action mailed Sep. 21, 2012, directed to U.S. Appl. No. 12/730,913; 13 pages.
Sunderland et al., U.S. Office Action mailed Dec. 24, 2012, directed to U.S. Appl. No. 12/730,890; 12 pages.
Sunderland et al., U.S. Office Action mailed Apr. 12, 2013, directed to U.S. Appl. No. 12/730,890; 9 pages.
Dyson et al., U.S. Office Action mailed Aug. 15, 2013, directed to U.S. Appl. No. 13/250,298; 12 pages.
Dyson et al., U.S. Office Action mailed Mar. 21, 2014, directed to U.S. Appl. No. 13/250,298; 10 pages.
Dyson et al., U.S. Office Action mailed Sep. 12, 2014, directed to U.S. Appl. No. 13/250,298; 11 pages.
Dyson et al., U.S. Office Action mailed Aug. 15, 2013, directed to U.S. Appl. No. 13/248,810 10 pages.
Dyson et al., U.S. Office Action mailed Mar. 26, 2014, directed to U.S. Appl. No. 13/248,810; 11 pages.
Dyson et al., U.S. Office Action mailed Jul. 23, 2014, directed to U.S. Appl. No. 13/248,810; 11 pages.
Wishney et al., U.S. Office Action mailed May 10, 2013, directed to U.S. Appl. No. 13/248,808; 21 pages.
Wishney et al., U.S. Office Action mailed Oct. 1, 2013, directed to U.S. Appl. No. 13/248,808; 19 pages.
Wishney et al., U.S. Office Action mailed Apr. 11, 2014, directed to U.S. Appl. No. 13/248,808; 23 pages.
Sunderland et al., U.S. Office Action mailed Jan. 27, 2014, directed to U.S. Appl. No. 13/248,824; 7 pages.

* cited by examiner

CANISTER VACUUM CLEANER

REFERENCE TO RELATED APPLICATIONS

This application is a continuation of U.S. application Ser. No. 14/081,652, filed Nov. 15, 2013, which is a continuation of U.S. application Ser. No. 12/730,428, filed Mar. 24, 2010, now U.S. Pat. No. 8,695,155, which claims the priority of United Kingdom Application No. 0905486.7, filed Mar. 31, 2009, the entire contents of which are incorporated herein by reference.

FIELD OF THE INVENTION

The present invention relates to a canister vacuum cleaner.

BACKGROUND OF THE INVENTION

Cleaning appliances such as vacuum cleaners are well known. The majority of vacuum cleaners are either of the "upright" type or of the "cylinder" type (called canister or barrel machines in some countries). Cylinder vacuum cleaners generally comprise a main body which contains a motor-driven fan unit for drawing a dirt-bearing fluid flow into the vacuum cleaner, and separating apparatus, such as a cyclonic separator or a bag, for separating dirt and dust from the fluid flow. The dirt-bearing fluid flow is introduced to the main body through a suction hose and wand assembly which is connected to the main body. The main body of the vacuum cleaner is dragged along by the hose as a user moves around a room. A cleaning tool is attached to the remote end of the hose and wand assembly.

For example, GB 2,407,022 describes a cylinder vacuum cleaner having a chassis which supports cyclonic separating apparatus. The vacuum cleaner has two main wheels, one on each side of a rear portion of the chassis, and a castor wheel located beneath the front portion of the chassis which allow the vacuum cleaner to be dragged across a surface. Such a castor wheel tends be mounted on a circular support which is, in turn, rotatably mounted on the chassis to allow the castor wheel to swivel in response to a change in the direction in which the vacuum cleaner is dragged over the surface.

SUMMARY OF THE INVENTION

The present invention provides a cleaning appliance in the form of a canister vacuum cleaner comprising a separating apparatus for separating dirt from a dirt-bearing fluid flow, a floor engaging rolling assembly, and a steering mechanism for steering the cleaning appliance as it is manoeuvred over a surface and for effecting relative pivotal movement between the separating apparatus and the rolling assembly.

The provision of a steering mechanism both for steering the cleaning appliance and for effecting relative pivotal movement between the separating apparatus and the rolling assembly can improve the manoeuvring of the appliance over a floor surface. By pivoting the separating apparatus relative to the rolling assembly, the separating apparatus can be "turned" relative to rolling assembly towards the direction in which the appliance is being steered, thereby moving the centre of gravity of the cleaning appliance towards the direction in which the appliance is being steered and improving the stability of the appliance. The turning of the separating apparatus towards the direction in which the appliance is being steered can also reduce the risk of the appliance becoming trapped against an upstanding item on the floor surface.

The rolling assembly is preferably substantially spherical. This can enable the direction in which the appliance is facing to be changed rapidly, for example through 180 degrees, by inclining the appliance so that the rolling assembly bears the full weight of the appliance, and "spinning" the appliance on the point of contact between the rolling assembly and the floor surface. The rolling assembly may comprise a substantially spherical casing which rotates as the cleaning appliance is moved over a floor surface. However, the appliance preferably comprises a main body and a plurality of floor engaging rolling elements rotatably connected to the main body, and which may together define a substantially spherical floor engaging rolling assembly. Each of the plurality of rolling elements is preferably in the form of a wheel rotatably connected to a respective side of the main body of the rolling assembly. Each of these rolling elements preferably has a curved, preferably dome-shaped, outer surface, and preferably has a rim which is substantially flush with the respective adjoining portion of the main body of the rolling assembly so that the rolling assembly may have a relatively continuous outer surface. This can further improve the manoeuvrability of the appliance. Ridges may be provided on the outer surface of the rolling elements to improve grip on the floor surface. A non-slip texture or coating may be provided on the outermost surface of the rolling elements to aid grip on slippery floor surfaces such as hard, shiny or wet floors.

The rotational axes of the rolling elements may be inclined upwardly towards the main body with respect to a floor surface upon which the cleaning appliance is located so that the rims of the rolling elements engage the floor surface. The angle of the inclination of the rotational axes is preferably in the range from 5 to 15°, more preferably in the range from 6 to 10°.

As a result of the inclination of the rotational axes of the rolling elements, part of the outer surface of the main body is exposed to enable components of the cleaning appliance, such as user-operable switches for activating the motor or a cable-rewind mechanism, to be located on the exposed part of the main body. In the preferred embodiment, one or more ports for exhausting the fluid flow from the cleaning appliance are located on the outer surface of the main body.

The rolling assembly preferably houses means for acting on the fluid flow. This means is preferably connected to the main body so as to not rotate as the cleaning appliance is moved over the floor surface. The means for acting on the fluid flow preferably comprises means for drawing the fluid flow through the separating apparatus, which preferably comprises an impeller and a motor for rotating the impeller. Alternatively, or additionally, the means for acting on the fluid flow may comprise a filter for removing particulates from the fluid flow. The filter preferably extends at least partially about the motor, and is preferably removable from the main body. For example, the filter may be accessed by removing part of the outer casing of the main body of the rolling assembly, or by disconnecting one of the rolling elements of the rolling assembly from the main body.

The separating apparatus is preferably located in front of the rolling assembly. The cleaning appliance preferably comprises an inlet duct for conveying a dirt-bearing fluid flow to the separating apparatus, and an outlet duct extending from the separating apparatus to the rolling assembly for conveying the fluid flow to the rolling assembly. The outlet duct is preferably detachable from the separating apparatus to allow the separating apparatus to be removed from the appliance for emptying or cleaning. To facilitate the detachment of the outlet duct from the separating apparatus, the outlet duct is preferably pivotably connected to the rolling assembly. The outlet duct is preferably connected to the upper surface of the rolling assembly so that it can be moved from a raised position to allow the separating apparatus to be removed from, and subsequently relocated on, the appliance, to a lowered position, in which the outlet duct is connected to the separating apparatus. In its lowered position, the outlet duct is preferably configured to retain the separating apparatus on the appliance. The outlet duct is preferably formed from a rigid material, preferably a plastics material, and preferably comprises a handle moveable therewith.

The appliance preferably comprises means for releasably retaining the outlet duct in the lowered position. This can inhibit accidental detachment of the outlet duct from the separating apparatus during use of the appliance, and also allows the appliance to be carried using the handle connected to the outlet duct. The outlet duct is preferably connected to the separating apparatus by a ball and socket joint through which the fluid flow enters the outlet duct. The fluid inlet of the outlet duct preferably comprises a convex outer surface for engaging a concave surface of a fluid outlet of the separating apparatus. The use of a ball and socket joint can allow a substantially fluid-tight seal to be maintained between the separating apparatus and the outlet duct as the separating apparatus pivots relative to the rolling assembly.

The separating apparatus is preferably in the form of a cyclonic separating apparatus having at least one cyclone, and which preferably comprises a chamber for collecting dirt separated from the fluid flow. Other forms of separator or separating apparatus can be used and examples of suitable separator technology include a centrifugal separator, a filter bag, a porous container, an electrostatic separator or a liquid-based separator.

The separating apparatus preferably comprises a handle to facilitate its removal from the appliance. This handle is preferably located beneath the outlet duct when the outlet duct is in its lowered position so that the handle is at least partially shielded by the outlet duct during use of the appliance. The handle is preferably moveable between a stowed position and a deployed position in which the handle is readily accessible by the user. The handle is preferably biased towards the deployed position. The outlet duct may be arranged to engage the handle so as to urge the handle towards its stowed position as the duct is moved to its lowered position.

The separating apparatus preferably comprises a wall and a base member, the base member being held in a closed position by means of a catch and being pivotably connected to the wall. The separating apparatus preferably comprises an actuating mechanism for operating the catch, and the handle of the separating apparatus preferably comprises a manually operable button for actuating the actuating mechanism. This button is preferably also located beneath the outlet duct when the outlet duct is in its lowered position and preferably between the handle and the main body of the rolling assembly when the handle is in its stowed position, to reduce the risk of accidental actuation of the actuating mechanism.

The steering mechanism preferably comprises a support for supporting the base of the separating apparatus. The support is preferably biased toward the outlet duct so as to urge the fluid outlet of the separating apparatus against the fluid inlet of the outlet duct to assist in maintaining the fluid-tight connection between the separating apparatus and the duct as the appliance is manoeuvred over a floor surface. The separating apparatus preferably comprises a substantially cylindrical outer wall which is supported by a curved support surface of the support. The separating apparatus preferably comprises a fluid inlet which is located adjacent the fluid outlet of the inlet duct when the separating apparatus is located on the support.

When it is located on the support the longitudinal axis of the separating apparatus, about which the wall of the separating apparatus extends, is preferably inclined at an acute angle to an axis about which the separating apparatus pivots relative to the rolling assembly so that the separating apparatus swings from side to side as the cleaning appliance is manoeuvred over the floor surface. The pivot axis preferably passes through the outlet duct for conveying the fluid flow from the separating apparatus to the rolling assembly, and more preferably through the inlet of the outlet duct, to further assist in maintaining the fluid-tight connection between the separating apparatus and the duct as the appliance is manoeuvred over a floor surface. This angle is preferably in the range from 30 to 70°. This pivot axis is preferably substantially vertical when the cleaning appliance is located on a substantially horizontal floor surface. The separating apparatus is preferably moveable relative to the rolling assembly about an arc which is preferably no greater than 90°, and more preferably no greater than 60°.

The inlet duct is preferably located at least partially beneath the separating apparatus when the separating apparatus is located on the support. The support is preferably connected to, or integral with, the inlet duct.

The steering mechanism preferably comprises a plurality of floor engaging steering members and a control mechanism for moving the steering members. Each of these steering members is preferably in the form of a wheel assembly. The separating apparatus is preferably pivotable about an axis which is substantially orthogonal to the rotational axes of the wheel assemblies. The distance between the points of contacts of the floor engaging rolling elements of the rolling assembly with a floor surface is preferably shorter that the distance between the points of contacts of the steering members with the floor surface to enhance the stability of the appliance.

The appliance preferably comprises a chassis. The chassis is preferably connected to the rolling assembly, more preferably to the main body of the rolling assembly. The chassis preferably comprises a body connected to the main body of the rolling assembly and a pair of side portions connected to, or integral with, the body of the chassis. Each side portion preferably has a front wall, with the walls being inclined at an angle in the range from 60 to 120°. The steering mechanism is preferably connected to the chassis. Each of the wheel assemblies is preferably rotatable relative to the chassis, and is preferably located behind one of the side portions of the chassis so that the chassis can shield the wheel assemblies from impact with walls, furniture or other items upstanding from the floor surface.

Each of the wheel assemblies is preferably pivotably connected to a respective side portion of the chassis so that the orientation of the steering members relative to the chassis may be changed, thereby changing the direction in which the cleaning appliance moves over the floor surface. The control mechanism preferably comprises a plurality of moveable steering arms each connecting a respective one of the steering members to the chassis. Each of these steering arms is preferably pivotably connected to the chassis, and more preferably at or towards the end of a respective side portion of the chassis. Each of the steering arms is preferably substantially L-shaped so as to extend about its respective wheel assembly to shield the wheel assembly from impact with any items located on the floor surface.

The control mechanism preferably comprises a control member for moving the steering arms relative to the chassis. The control member is preferably in the form of a control arm which is moveable relative to the chassis. The control member is coupled, preferably pivotably coupled, at or towards each end thereof to a respective steering arm so that movement of the control member relative to the chassis causes each steering arm to pivot by a respective different amount relative to the chassis to provide a relatively smooth turning movement of the appliance over the floor surface.

The control mechanism preferably comprises a lever pivotably connected to the chassis so that rotation of the lever about its pivot axis moves the control member relative to the chassis. The separating apparatus and the lever are preferably pivotable about the same axis. The lever and the control member preferably comprise interengaging features which enable the control member to move both in an axial direction and in a rotational manner relative to the chassis with rotation of the lever. In the preferred embodiment these interengaging features comprises a protrusion located on the control member which is retained by and moveable within a notch, slot or groove located on the lever. The lever is preferably rotatable about a spindle projecting from the chassis.

The lever is preferably connected to the inlet duct, which is moveable, preferably pivotably moveable, relative to the rolling assembly to actuate movement of the lever. The inlet duct may therefore be considered to form part of the steering mechanism of the appliance.

The inlet duct may comprise a relatively flexible inlet section and a relatively rigid outlet section. The inlet section preferably comprises a flexible hose connected to the outlet section of the inlet duct. The lever of the steering mechanism is preferably connected to, and more preferably integral with, the outlet section of the inlet duct so that movement of the inlet section of the inlet duct causes both the outlet section of the inlet duct and the lever to rotate about the pivot axis of the lever. The support for supporting the separating apparatus may be connected to the outlet section of the inlet duct. A coupling may be provided at one end of the inlet duct for connection to a hose and wand assembly which the user pulls in order to drag the appliance over the floor surface.

The appliance preferably comprises a hose support pivotable relative to the rolling assembly for supporting the hose, and preferably connected at or towards the front end of the body of the chassis so as to extend outwardly from the chassis. The hose support preferably comprises a floor engaging rolling element to allow the hose support to move smoothly over the floor surface as the cleaning appliance is manoeuvred over the floor surface. The pivot axis of the hose support is preferably spaced from the pivot axis of the lever, and is preferably substantially parallel to the pivot axis of the lever. The hose is preferably constrained to move within a plane substantially parallel to the axis of rotation of the floor engaging rolling element. The hose support is preferably pivotable relative to the rolling assembly about an arc no greater than 180°, more preferably no greater than 142°.

Although an embodiment of the invention is described in detail with reference to a vacuum cleaner, it will be appreciated that the invention can also be applied to other forms of cleaning appliance. The term "cleaning appliance" is intended to have a broad meaning, and includes a wide range of machines having a main body and means for carrying fluid to or from a floor surface. It includes, inter alia, machines which only apply suction to the surface, such as vacuum cleaners (dry, wet and wet/dry variants), so as to draw material from the surface, as well as machines which apply material to the surface, such as polishing/waxing machines, pressure washing machines and shampooing machines.

BRIEF DESCRIPTION OF THE DRAWINGS

An embodiment of the present invention will now be described, by way of example only, with reference to the accompanying drawings, in which:

FIG. 14(*b*) is a sectional view through line I-I in FIG. 12;

FIG. 14(*c*) is a perspective view of the cross-over duct assembly of the separating apparatus of FIG. 12;

FIG. 21(*b*) is a side sectional view taken along line J-J of FIG. 4;

DETAILED DESCRIPTION OF THE INVENTION

Figure 1:
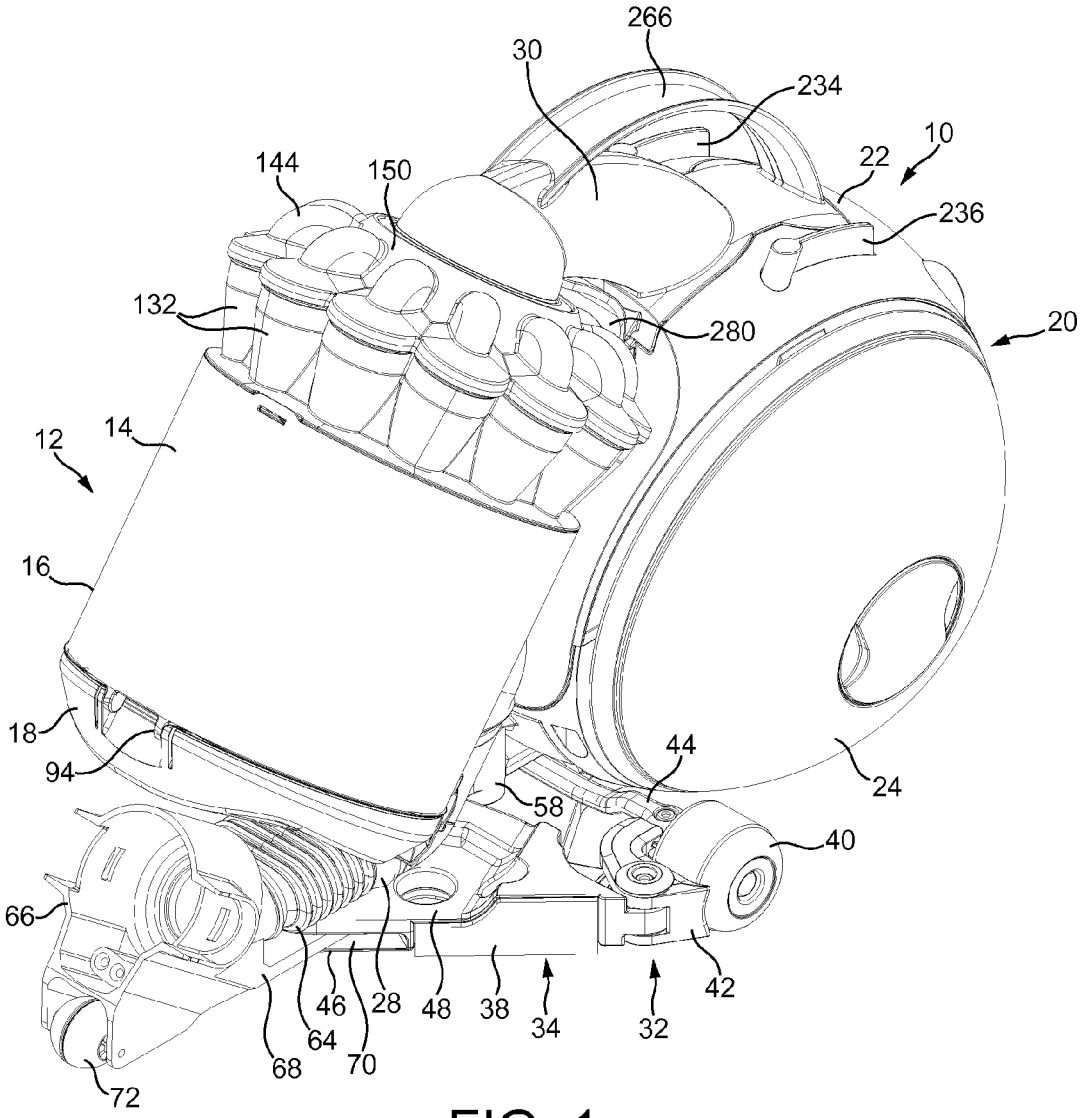
FIG. 1 is a perspective view of a vacuum cleaner.
Figure 2:
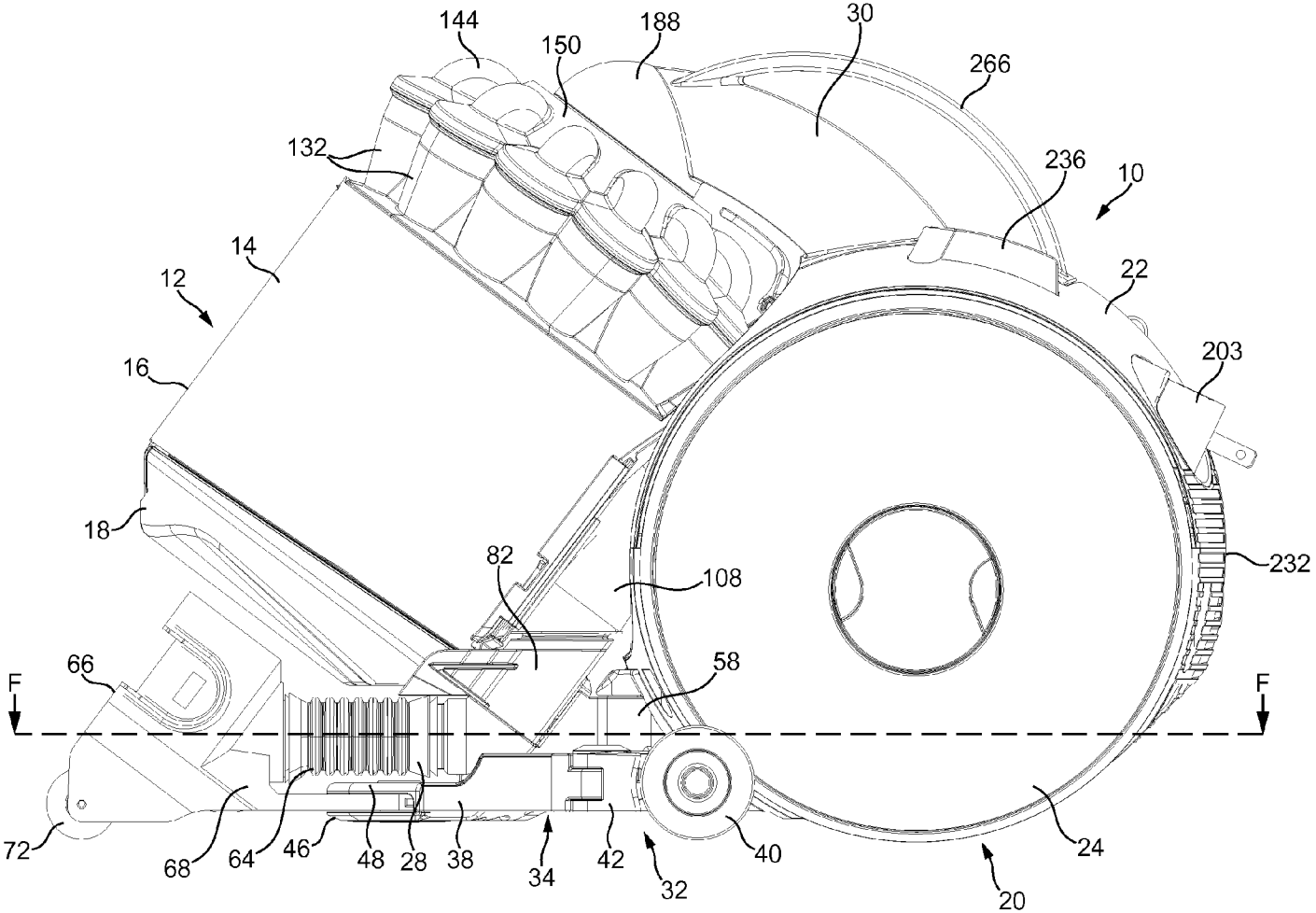
FIG. 2 is a side view of the vacuum cleaner of FIG. 1.
Figure 3:
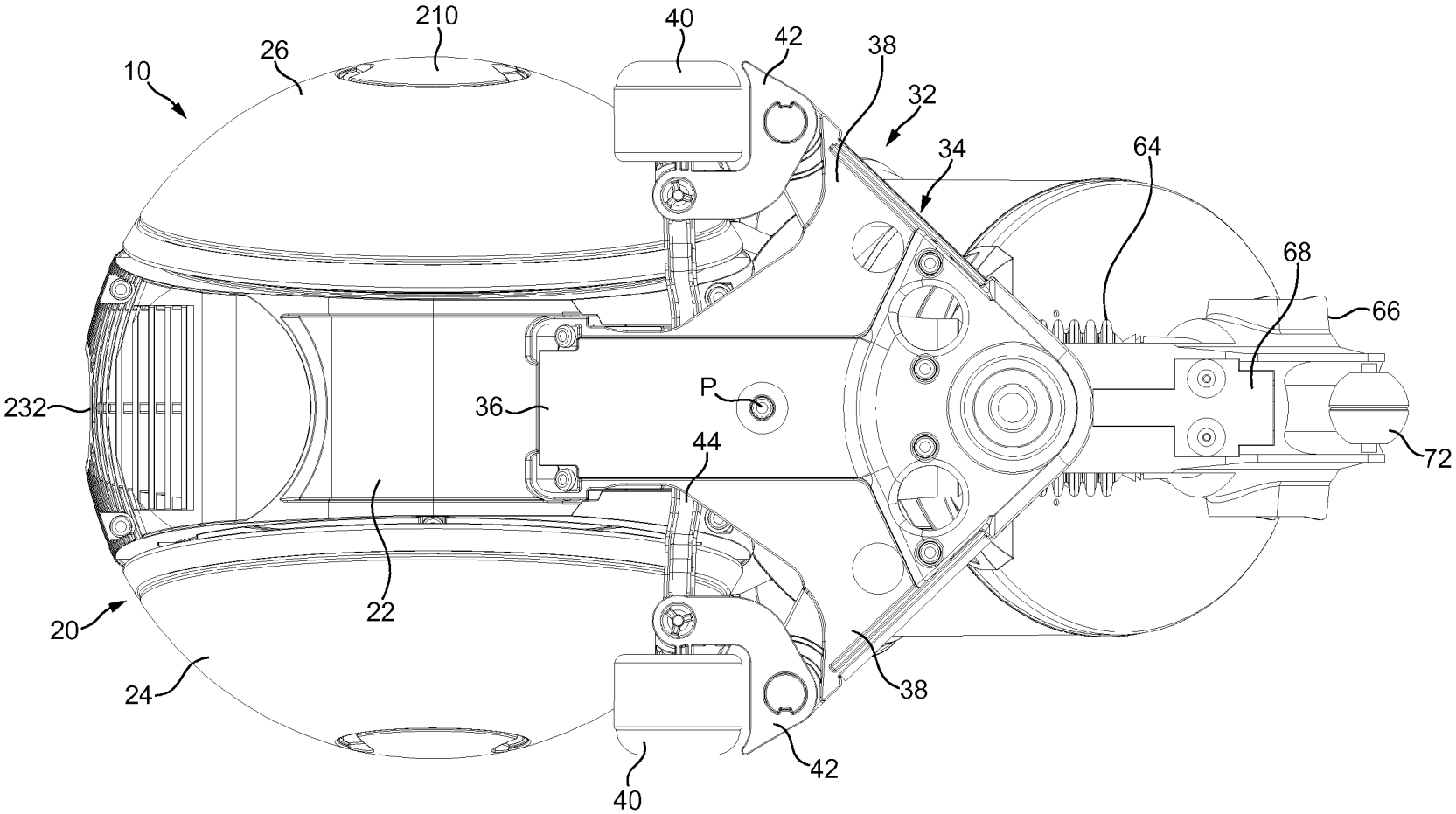
FIG. 3 is an underside view of the vacuum cleaner of FIG. 1.

FIGS. 1 to 4 illustrate external views of a cleaning appliance in the form of a vacuum cleaner 10. The vacuum cleaner 10 is of the cylinder, or canister, type. In overview, the vacuum cleaner 10 comprises separating apparatus 12 for separating dirt and dust from an airflow. The separating apparatus 12 is preferably in the form of cyclonic separating apparatus, and comprises an outer bin 14 having an outer wall 16 which is substantially cylindrical in shape. The lower end of the outer bin 14 is closed by curved base 18 which is pivotably attached to the outer wall 16. A motor-driven fan unit for generating suction for drawing dirt laden air into the separating apparatus 12 is housed within a rolling assembly 20 located behind the separating apparatus 12. The rolling assembly 20 comprises a main body 22 and two wheels 24, 26 rotatably connected to the main body 22 for engaging a floor surface. An inlet duct 28 located beneath the separating apparatus 12 conveys dirt-bearing air into the separating apparatus 12, and an outlet duct 30 conveys air exhausted from the separating apparatus 12 into the rolling assembly 20. A steering mechanism 32 steers the vacuum cleaner 10 as it is manoeuvred across a floor surface to be cleaned.

The steering mechanism 32 comprises a chassis 34 connected to the main body 22 of the rolling assembly 20. The chassis 34 is generally arrow-shaped, and comprises an elongate body 36 connected at the rear end thereof to the main body 22 of the rolling assembly 20, and a pair of side portions 38 each extending rearwardly from the front end of the elongate body 36 and inclined to the elongate body 36. The inclination of the front walls of the side portions 38 of the chassis 34 can assist in manoeuvring the vacuum cleaner 10 around corners, furniture or other items upstanding from the floor surface, as upon contact with such an item these front walls of the slide portions 38 of the chassis 34 tend to slide against the upstanding item to guide the rolling assembly 20 around the upstanding item.

The steering mechanism 32 further comprises a pair of wheel assemblies 40 for engaging the floor surface, and a control mechanism for controlling the orientation of the wheel assemblies 40 relative to the chassis 34, thereby controlling the direction in which the vacuum cleaner 10 moves over the floor surface. The wheel assemblies 40 are located behind the side portions 38 of the chassis 34, and in front of the wheels 24, 26 of the rolling assembly 20. The wheel assemblies 40 may be considered as articulated front wheels of the vacuum cleaner 10, whereas the wheels 24, 26 of the rolling assembly 20 may be considered as the rear wheels of the vacuum cleaner 10.

In addition to steering the vacuum cleaner 10 over a floor surface, the wheel assemblies 40 form support members for supporting the rolling assembly 20 as it is manoeuvred over a floor surface, restricting rotation of the rolling assembly 20 about an axis which is orthogonal to the rotational axes of the wheel assemblies 40, and substantially parallel to the floor surface over which the vacuum cleaner 10 is being manoeuvred. The distance between the points of contact of the wheel assemblies 40 with the floor surface is greater than that between the points of contact of the wheels 24, 26 of the rolling assembly 20 with that floor surface. In this example, the distance between the points of contact of the wheel assemblies 40 with the floor surface is approximately twice the distance between the points of contact of the wheels 24, 26 of the rolling assembly 20 with that floor surface.

The control mechanism comprises a pair of steering arms 42 each connecting a respective wheel assembly 40 to the chassis 34. Each steering arm 42 is substantially L-shaped so as to curve around its respective wheel assembly 40. Each steering arm 42 is pivotably connected at a first end thereof to the end of a respective side portion 38 of the chassis 34 for pivoting movement about a respective hub axis H. Each hub axis H is substantially orthogonal to the axes of rotation of the wheel assemblies 40. The second end of each steering arm 42 is connected to a respective wheel assembly 40 so that the wheel assembly 40 is free to rotate as the vacuum cleaner 10 is moved over the floor surface. As shown, for example, in FIG. 3, the outer surfaces of the steering arms 42 have a similar inclination to the front walls of the side portions 38 of the chassis 34 so that if a side portion 38 of the chassis 34 comes into contact with an upstanding item, the steering arm 42 connected to that side portion 38 can also assist in guiding the rolling assembly 20 and the wheel assemblies 40 around the upstanding item.

Figure 5:
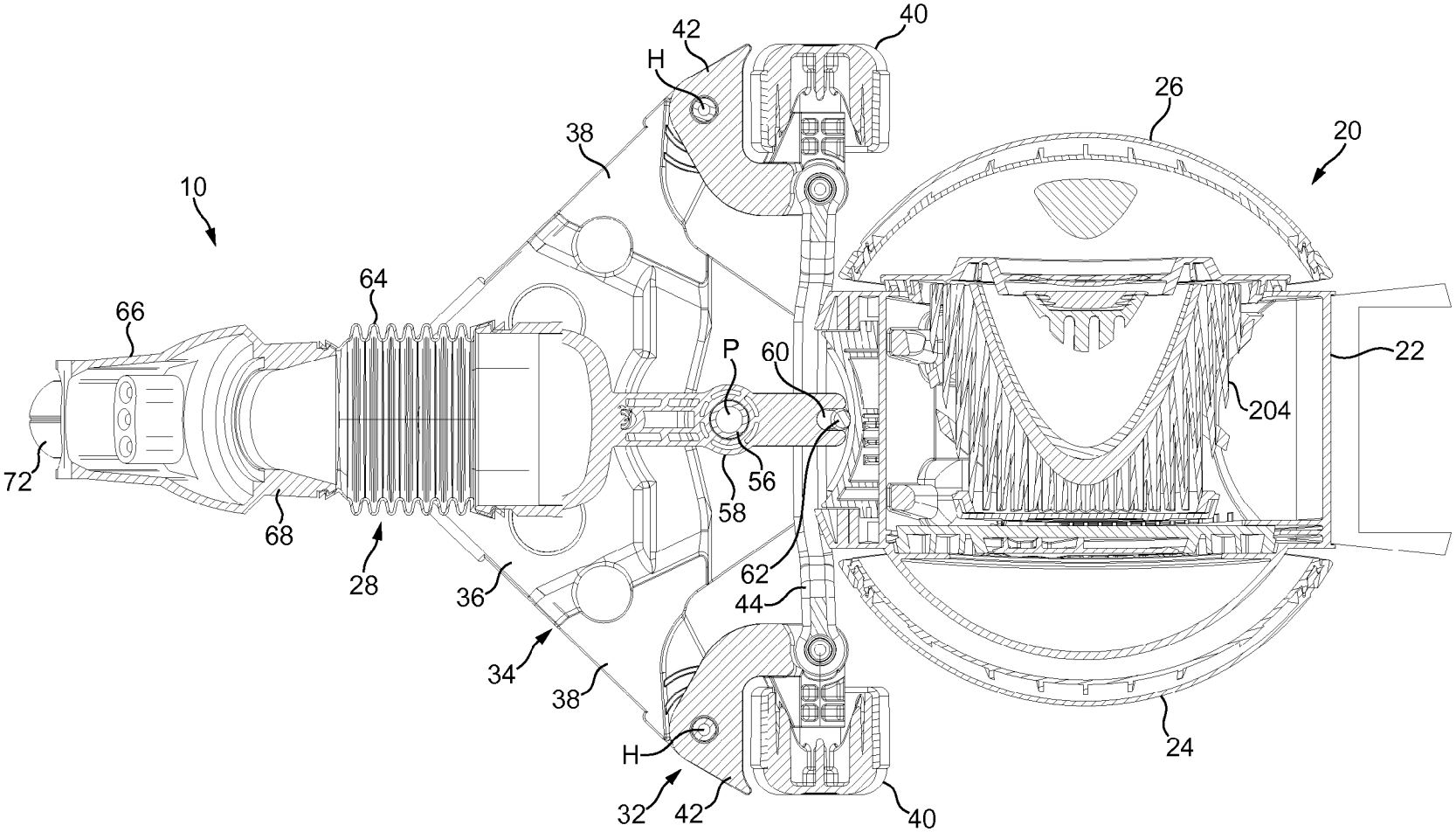
FIG. 5 is a sectional view taken along line F-F in FIG. 2.
Figure 6:
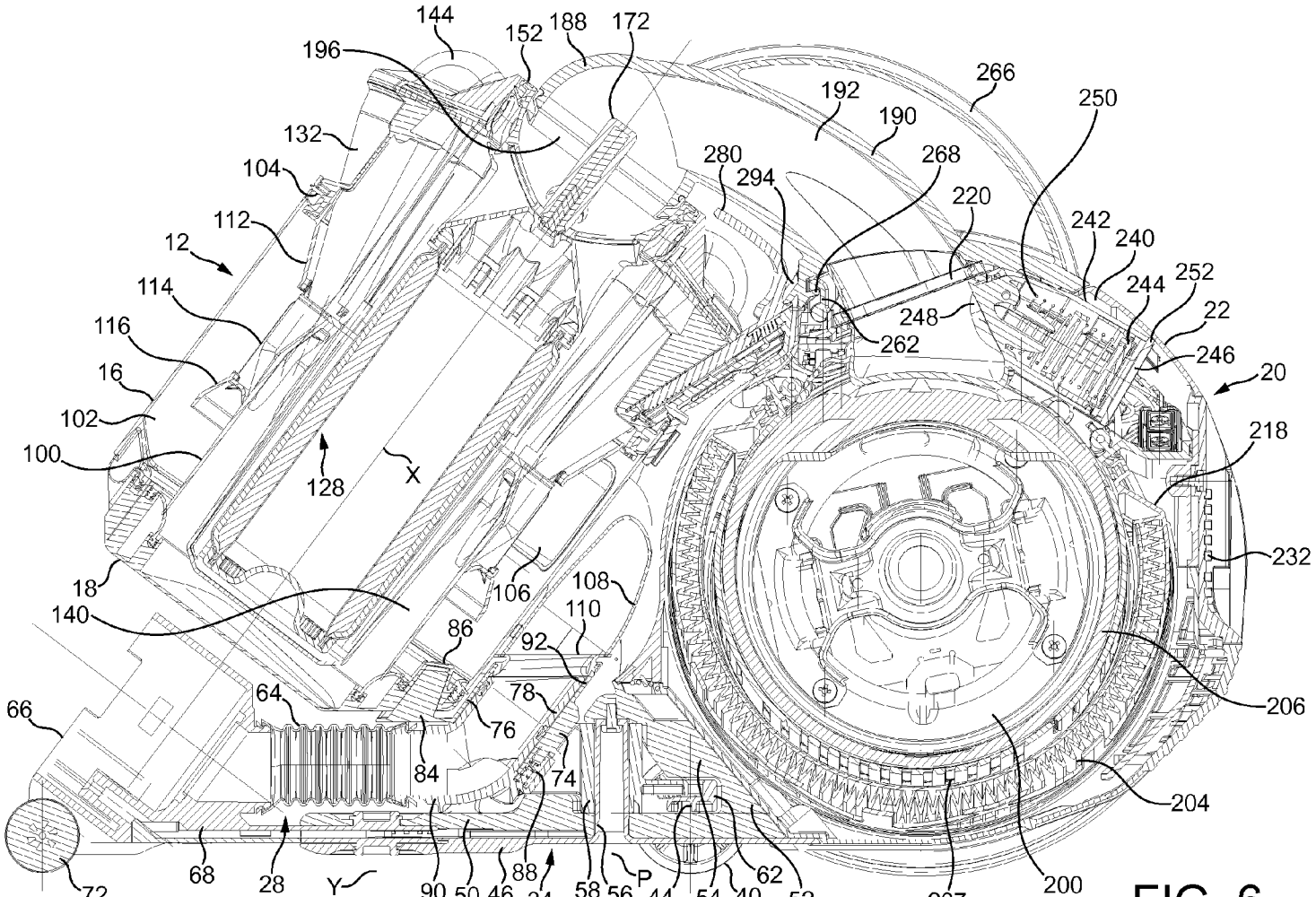
FIG. 6 is a sectional view taken along line G-G in FIG. 4.

The control mechanism also comprises an elongate track control arm 44 for controlling the pivoting movement of the steering arms 42 about their hub axes H, thereby controlling the direction in which the vacuum cleaner 10 moves over the floor surface. With reference also to FIGS. 5 and 6, the chassis 34 comprises a lower chassis section 46 which is connected to the main body 22 of the rolling assembly 20, and an upper chassis section 48 connected to the lower chassis section 46. Each chassis section 46, 48 may be formed from one or more component parts. The upper chassis section 48 comprises a generally flat lower portion 50 which forms, with the lower chassis section 46, the body 36 and the side portions 38 of the chassis 34. The upper chassis section 48 also comprises an end wall 52 upstanding from the lower portion 50, and a profiled upper portion 54 connected to the end wall 52 and extending over part of the lower portion 50. The middle of the track control arm 44 is retained between the lower portion 50 and the upper portion 54 of the upper chassis section 48. The track control arm 44 is oriented relative to the chassis 32 so as to be substantially orthogonal to the body 36 of the chassis 34 when the vacuum cleaner 10 is moving forwards over the floor surface. Each end of the track control arm 44 is connected to the second end of a respective steering arm 42 so that movement of the track control arm 44 relative to the chassis 34 causes each steering arm 42 to pivot about its hub axis H. This in turn causes each wheel assembly 40 to orbit about the end of its respective side portion 38 of the chassis 34 to change the direction of the movement of the vacuum cleaner 10 over the floor surface.

With reference to FIG. 6, the lower chassis section 46 comprises a spindle 56 extending substantially orthogonally upward therefrom, and which passes through an aperture formed in the lower portion 50 of the upper casing section 48. The upper portion 54 of the upper casing section 48 comprises a recess for receiving the upper end of the spindle 56. The longitudinal axis of the spindle 56 defines a main pivot axis P of the steering mechanism 32. Pivot axis P is substantially parallel to the hub axes H.

The inlet duct 28 for conveying dirt-bearing air into the separating apparatus 12 is pivotably connected to the chassis 34. The inlet duct 28 comprises a rearwardly extending arm 58 which is also retained between the lower portion 50 and the upper portion 54 of the upper chassis section 48. The arm 58 comprises an aperture for receiving the spindle 56 of the lower chassis section 46 so that the arm 58 is pivotable about axis P. The arm 58 also comprises a slot 60 for receiving a pin 62 connected to the track control arm 44, and within which the pin 62 is moveable as the arm 58 pivots about the axis P. The engagement between the slot 60 and the pin 62 causes the track control arm 44 to move relative to the chassis 34 as the arm 58 pivots about axis P. The arm 58, and therefore the inlet duct 28, may be considered to form part of the steering mechanism 32 for steering the vacuum cleaner 10 over a floor surface.

Returning to FIGS. 1 to 5, the inlet duct 28 comprises a relatively flexible inlet section and a relatively rigid outlet section to which the arm 58 is connected. The inlet section of the inlet duct 28 comprises a flexible hose 64 connected at one end thereof to the outlet section of the inlet duct 28 and at the other end thereof to a coupling 66 for connection to a wand and hose assembly (not shown) for conveying the duct-bearing airflow to the inlet duct 28. The wand and hose assembly is connected to a cleaner head (not shown) comprising a suction opening through which a dirt-bearing airflow is drawn into the vacuum cleaner 10. The hose 64 is omitted from FIGS. 6 to 10 for clarity purposes only. The steering mechanism 32 comprises a yoke 68 for supporting the hose 64 and the coupling 66, and for connecting the coupling 66 to the chassis 34. The yoke 68 comprises a front section extending forwardly from the front of the chassis 34, and a rear section which is located between the lower chassis section 46 and the upper chassis section 48. The rear section of the yoke 68 is connected to the chassis 34 for pivoting movement about a yoke pivot axis Y. Axis Y is spaced from, and substantially parallel to, axis P. The chassis 34 is shaped to define an opening 70 through which the yoke 68 protrudes from the chassis 34, and which restricts the pivoting movement of the yoke 68 relative to the chassis 34 to within a range of ±65°. The yoke 68 comprises a floor engaging rolling element 72 for supporting the yoke 68 on the floor surface, and which has a rotational axis which is substantially orthogonal to axis Y.

Figure 9:
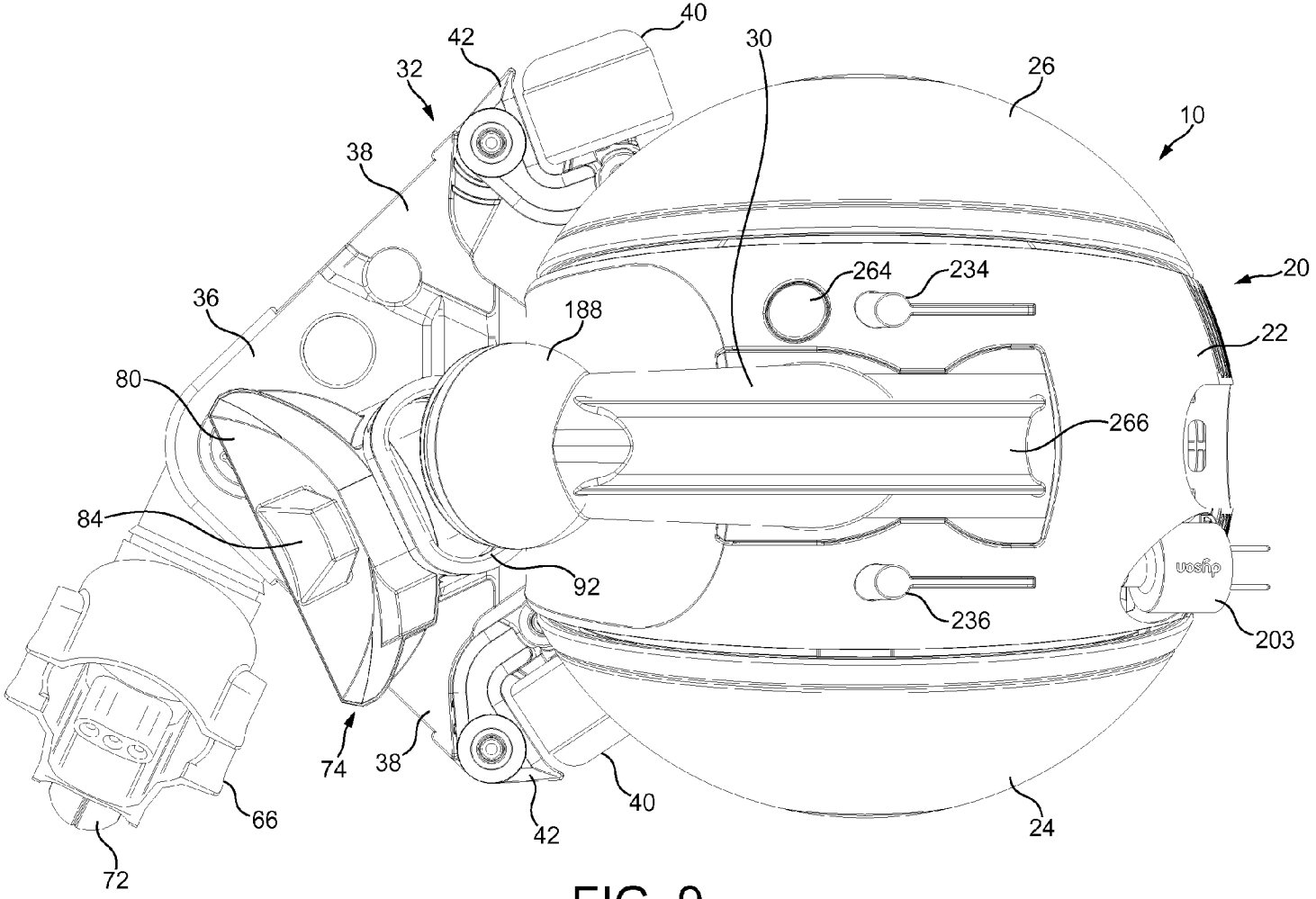
FIG. 9 is a top view of the vacuum cleaner of FIG. 1, with the chassis articulated in one direction and the separating apparatus removed.
Figure 10:
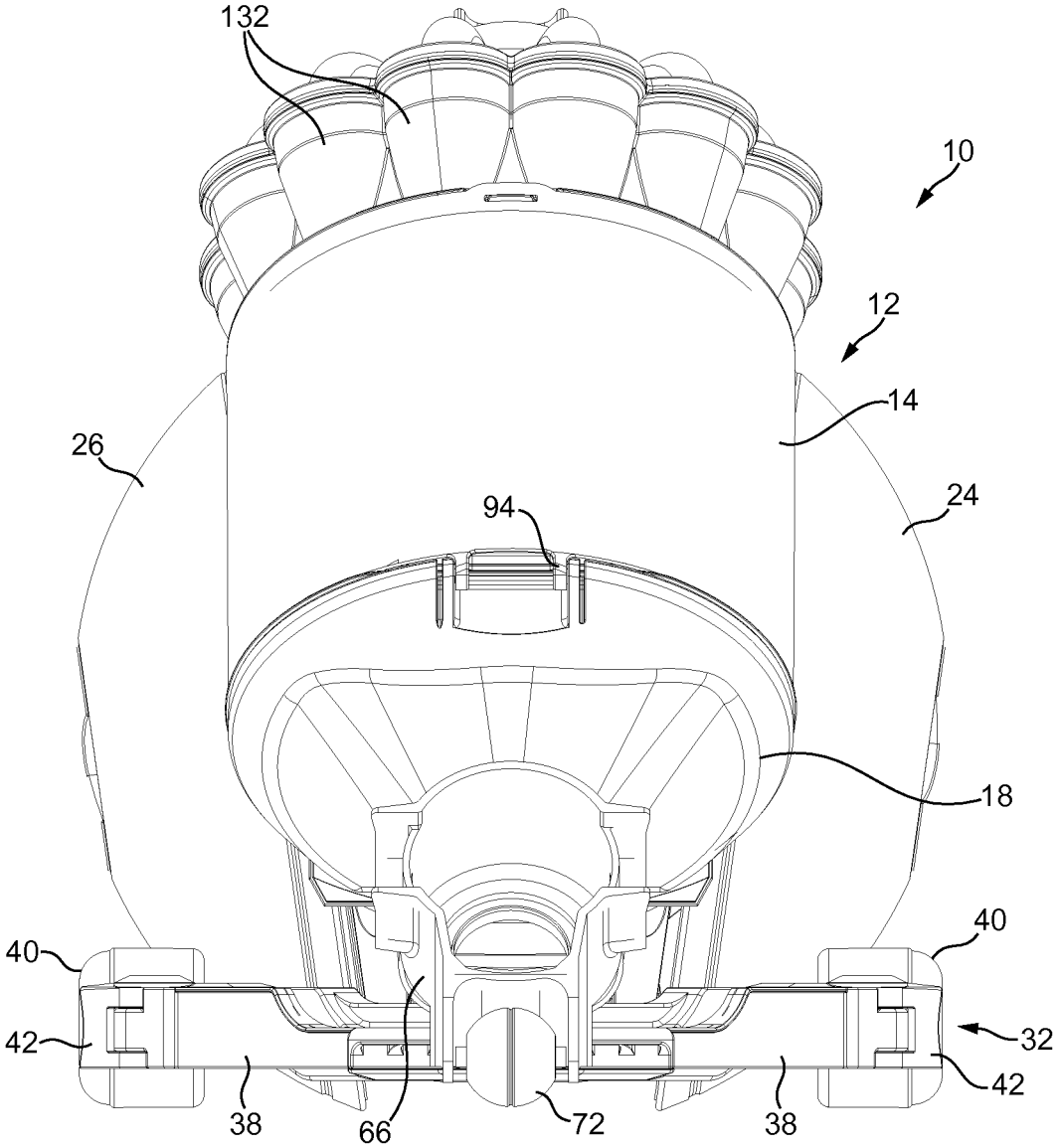
FIG. 10 is a front view of the vacuum cleaner of FIG. 1, with the separating apparatus removed.
Figure 11:
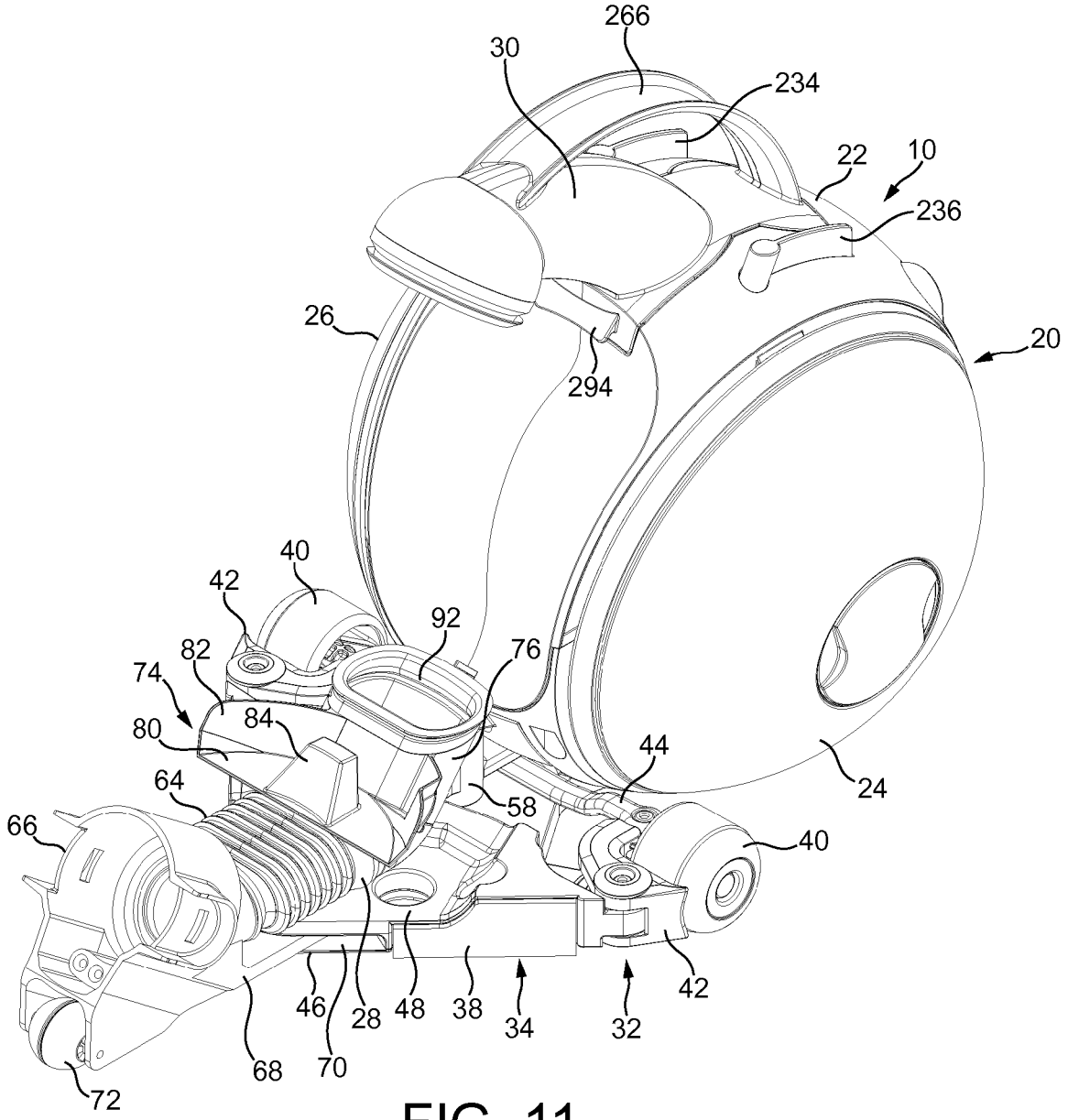
FIG. 11 is a perspective view of the vacuum cleaner of FIG. 1, with the separating apparatus removed.
Figure 12:
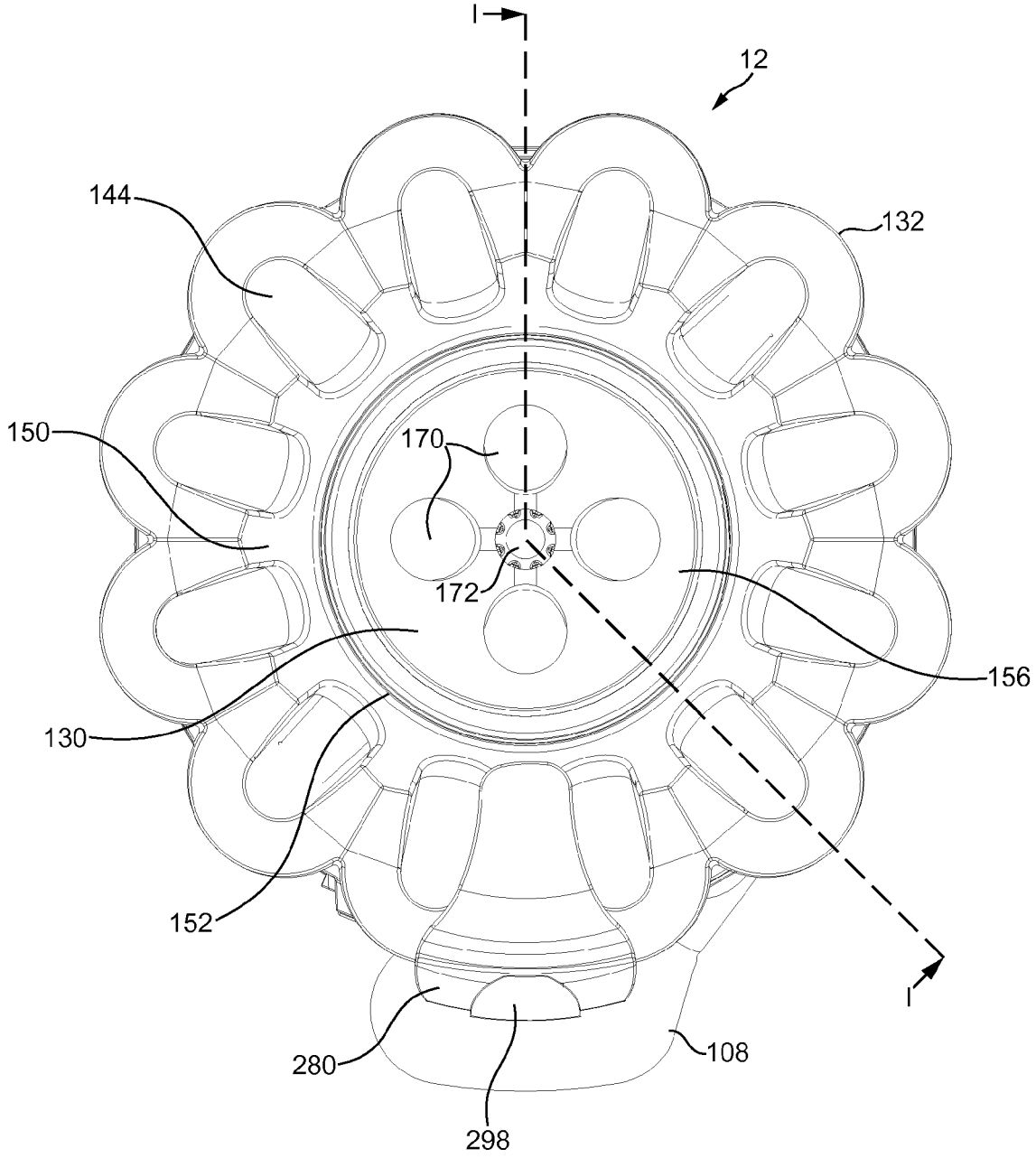
FIG. 12 is a top view of the separating apparatus of the vacuum cleaner of FIG. 1.
Figure 13:
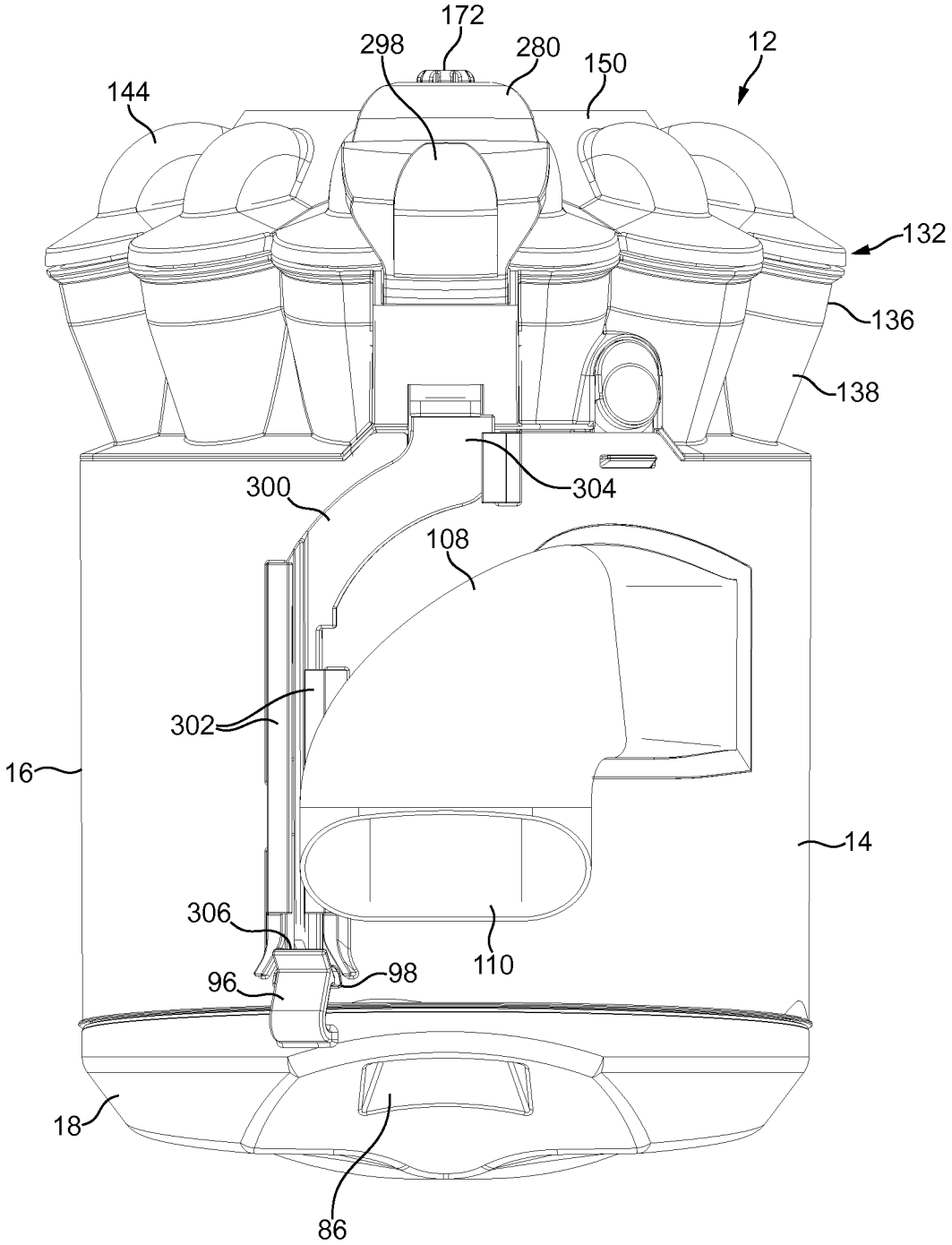
FIG. 13 is a rear view of the separating apparatus of FIG. 12.

The vacuum cleaner 10 comprises a support 74 upon which the separating apparatus 12 is removably mounted. The support 74 is connected to the outlet section of the inlet duct 28 for movement therewith as the arm 58 pivots about axis P. With particular reference to FIGS. 6, 9 and 11, in this example the support 74 comprises a sleeve 76 which extends about an inclined section 78 of the outlet section of the inlet duct 28, and a platform 80 which extends forwardly, an generally horizontally, from the sleeve 76. The platform 80 has a curved rear wall 82 which is connected to the sleeve 76, and which has a radius of curvature which is substantially the same as that of the outer wall 16 of the outer bin 14 of the separating apparatus 12 to assist with the location of the separating apparatus 12 on the support 74. A spigot 84 extends upwardly from the platform 80 for location within a recess 86 formed on the base 18 of the outer bin 14.

The support 74 is preferably biased in an upward direction so that the separating apparatus 12 is biased toward the outlet duct 30 of the vacuum cleaner 10. This assists in maintaining an air-tight seal between the separating apparatus 12 and the outlet duct 30. For example, a resilient element 88, preferably a helical spring, is located within a housing formed at the rear of the inlet duct 28 for engaging the support 74 to urge the support 74 upwardly in a direction which is preferably substantially parallel to the longitudinal axis of the outer bin 14 when the separating apparatus 12 is mounted on the support 74.

When the separating apparatus 12 is mounted on the support 74, the longitudinal axis of the outer bin 14 is inclined to the axis P, in this example by an angle in the range from 30 to 40°. Consequently, pivoting movement of the inlet duct 28 about axis P during a cleaning operation causes the separating apparatus 12 to pivot, or swing, about axis P, relative to the chassis 34, the rolling assembly 20 and the outlet duct 30.

The inclined section 78 of the inlet duct 28 extends alongside the outer wall 16 of the outer bin 14 of the separating apparatus 12, and is substantially parallel to the longitudinal axis of the outer bin 14 when the separating apparatus 12 is mounted on the support 74. The arm 58 is preferably connected to the rear of the inclined section 78 of the inlet duct 28. The outlet section of the inlet duct 28 also comprises a horizontal section 90 located beneath the platform 80 for receiving the dirt-bearing airflow from the hose 64 and conveying the airflow to the inclined section 78. The outlet section of the inlet duct 28 further comprises an outlet 92 from which the dust-bearing airflow enters the separating apparatus 12.

Figure 7:
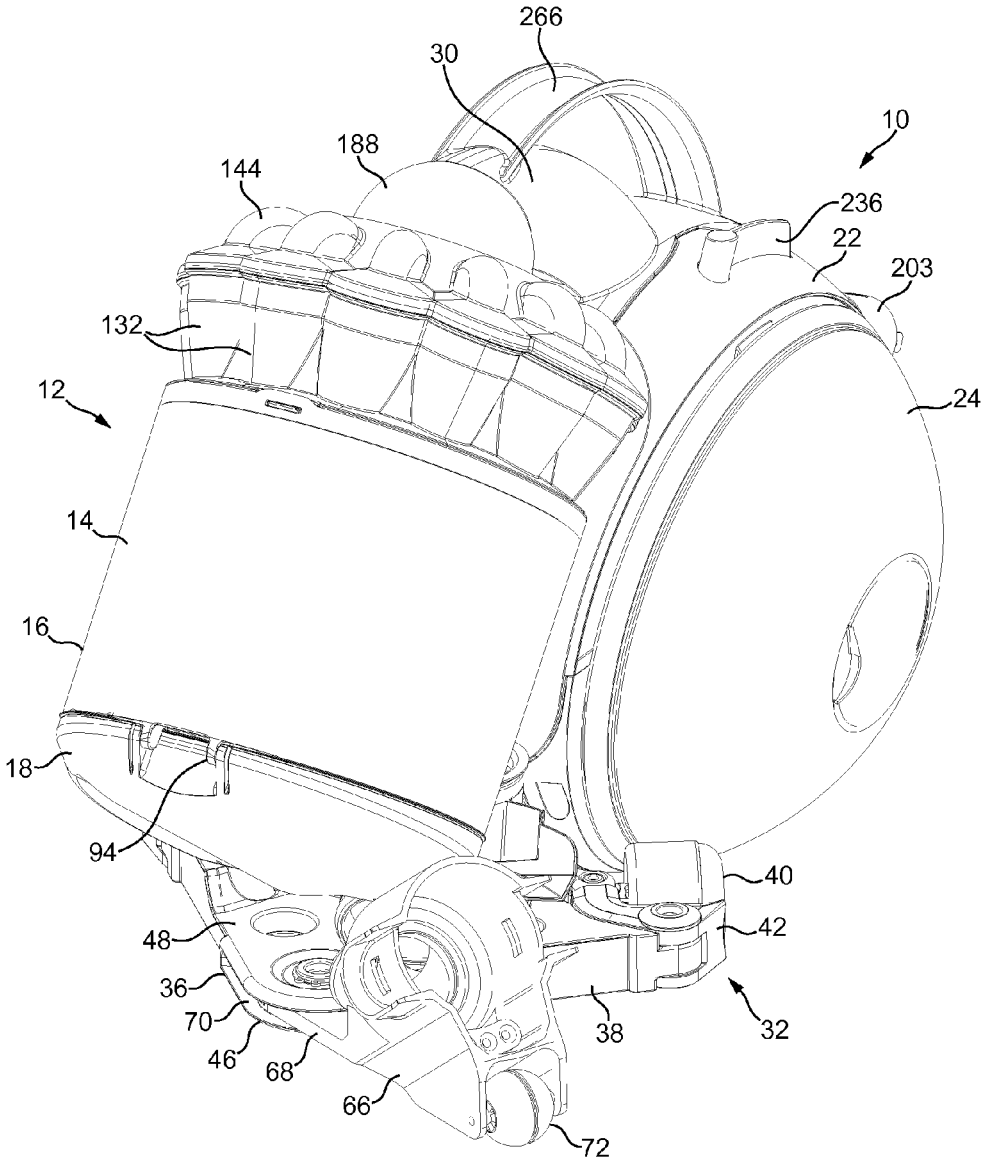
FIG. 7 is a perspective view of the vacuum cleaner of FIG. 1, with the chassis articulated in one direction.
Figure 8:
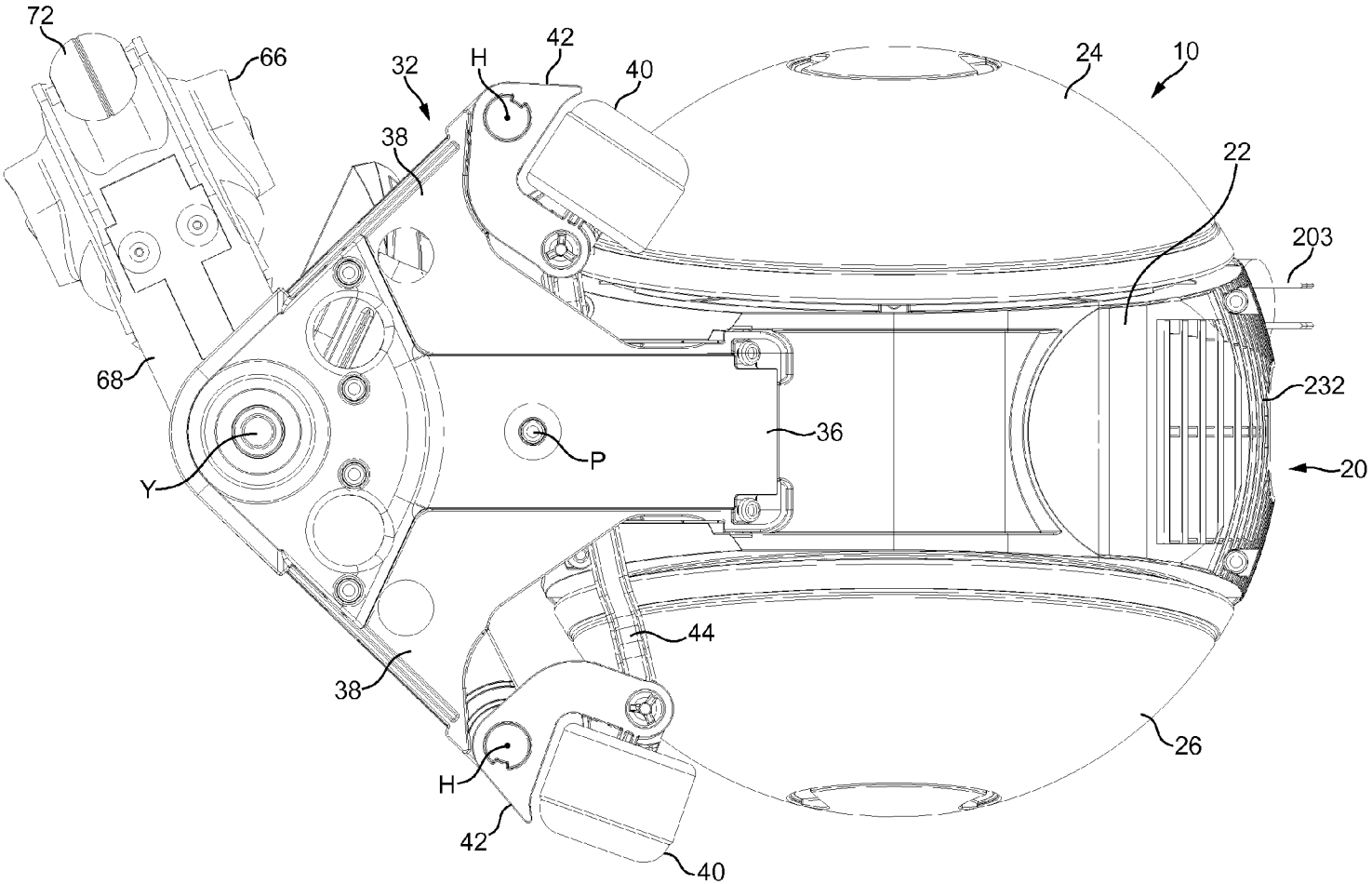
FIG. 8 is an underside view of the vacuum cleaner of FIG. 1, with the chassis articulated in one direction and the separating apparatus removed.

To manoeuvre the vacuum cleaner 10 over the floor surface, the user pulls the hose of the hose and wand assembly connected to the coupling 66 to drag the vacuum cleaner 10 over the floor surface, which in turn causes the wheels 24, 26 of the rolling assembly 20, the wheel assemblies 40 and the rolling element 72 to rotate and move the vacuum cleaner 10 over the floor surface. With reference also to FIGS. 7 to 9, to steer the vacuum cleaner 10 to the left, for example, as it is moving across the floor surface, the user pulls the hose of the hose and wand assembly to the left so that the coupling 66 and the yoke 68 connected thereto pivot to the left about axis Y. This pivoting movement of the yoke 68 about axis Y causes the hose 64 to flex and exert a force on the horizontal section 90 of the outlet section of the inlet duct 28. This force causes the inclined section 78 and the arm 58 attached thereto to pivot to the left about axis P. With particular reference to FIG. 9, due to the flexibility of the hose 64, the amount by which the yoke 68 pivots about axis Y is greater than the amount by which the inlet duct 28 pivots about axis P. For example, when the yoke 68 is pivoted about axis Y by an angle of 65° the inlet duct 28 is pivoted about axis P by an angle of around 25°. As the arm 58 pivots about axis P, the pin 62 connected to the track control arm 44 moves with and within the slot 60 of the arm 58, causing the track control arm 44 to move relative to the chassis 34. With particular reference to FIGS. 8 and 9, the movement of the track control arm 44 causes each steering arm 42 to pivot about its respective hub axis H so that the wheel assemblies 40 turn to the left, thereby changing the direction in which the vacuum cleaner 10 moves over the floor surface. The control mechanism is preferably arranged so that movement of the track control arm 44 relative to the chassis 34 causes each wheel assembly 40 to turn by a respective different amount relative to the chassis 34.

The separating apparatus 12 will now be described with reference to FIGS. 6, 12 to 14 and FIGS. 16 to 18. The specific overall shape of the separating apparatus 12 can be varied according to the size and type of vacuum cleaner in which the separating apparatus 12 is to be used. For example, the overall length of the separating apparatus 12 can be increased or decreased with respect to the diameter of the apparatus, or the shape of the base 18 can be altered.

As mentioned above, the separating apparatus 12 comprises an outer bin 14 which has an outer wall 16 which is substantially cylindrical in shape. The lower end of the outer bin 14 is closed by a curved base 18 which is pivotably attached to the outer wall 16 by means of a pivot 94 and held in a closed position by a catch 96 which engages a lip 98 located on the outer wall 16. In the closed position, the base 18 is sealed against the lower end of the outer wall 16. The catch 96 is resiliently deformable so that, in the event that downward pressure is applied to the uppermost portion of the catch 96, the catch 96 will move away from the lip 98 and become disengaged therefrom. In this event, the base 18 will drop away from the outer wall 16.

Figure 14A:
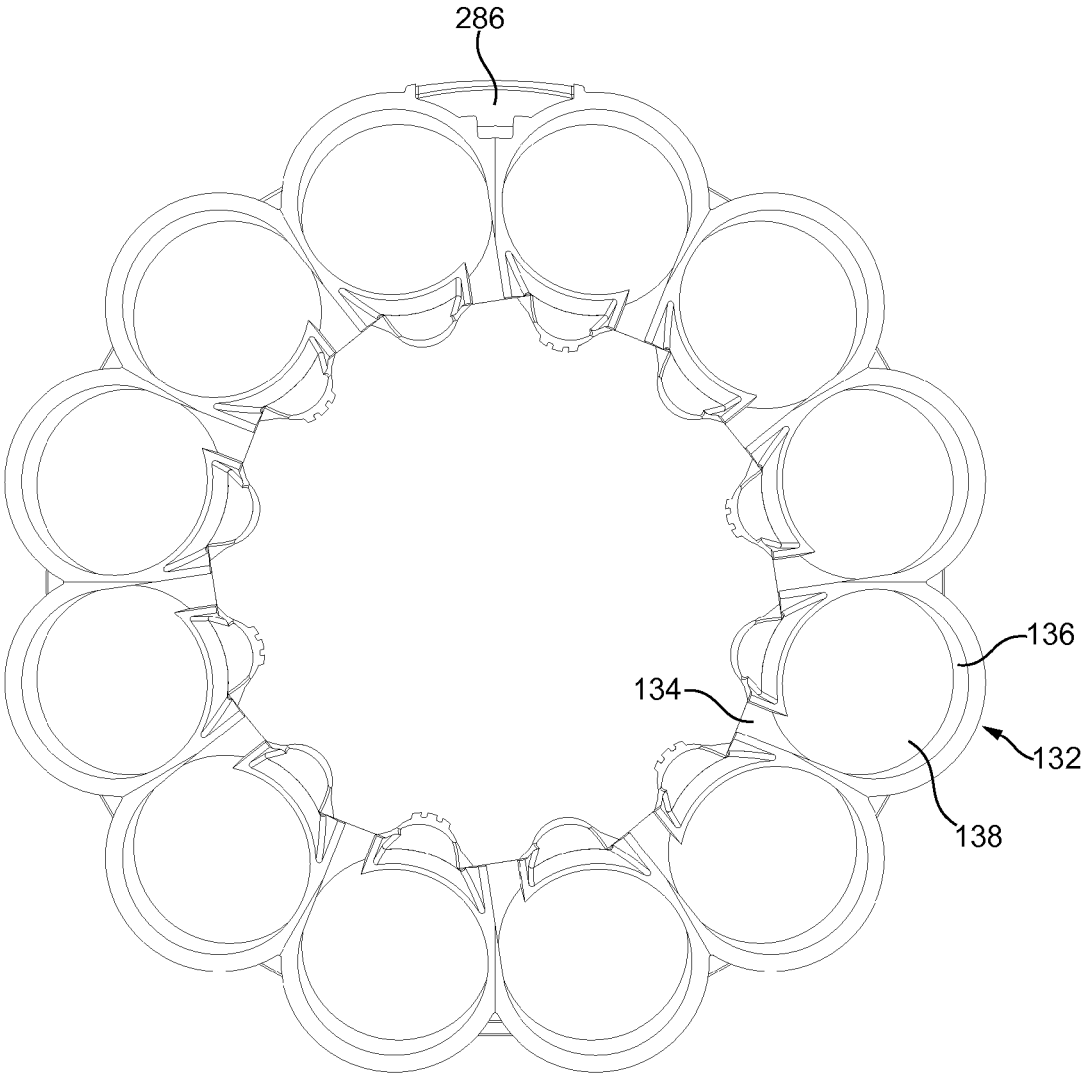
FIG. 14(*a*) is top view of a portion of the separating apparatus of FIG. 12.
Figure 14B:
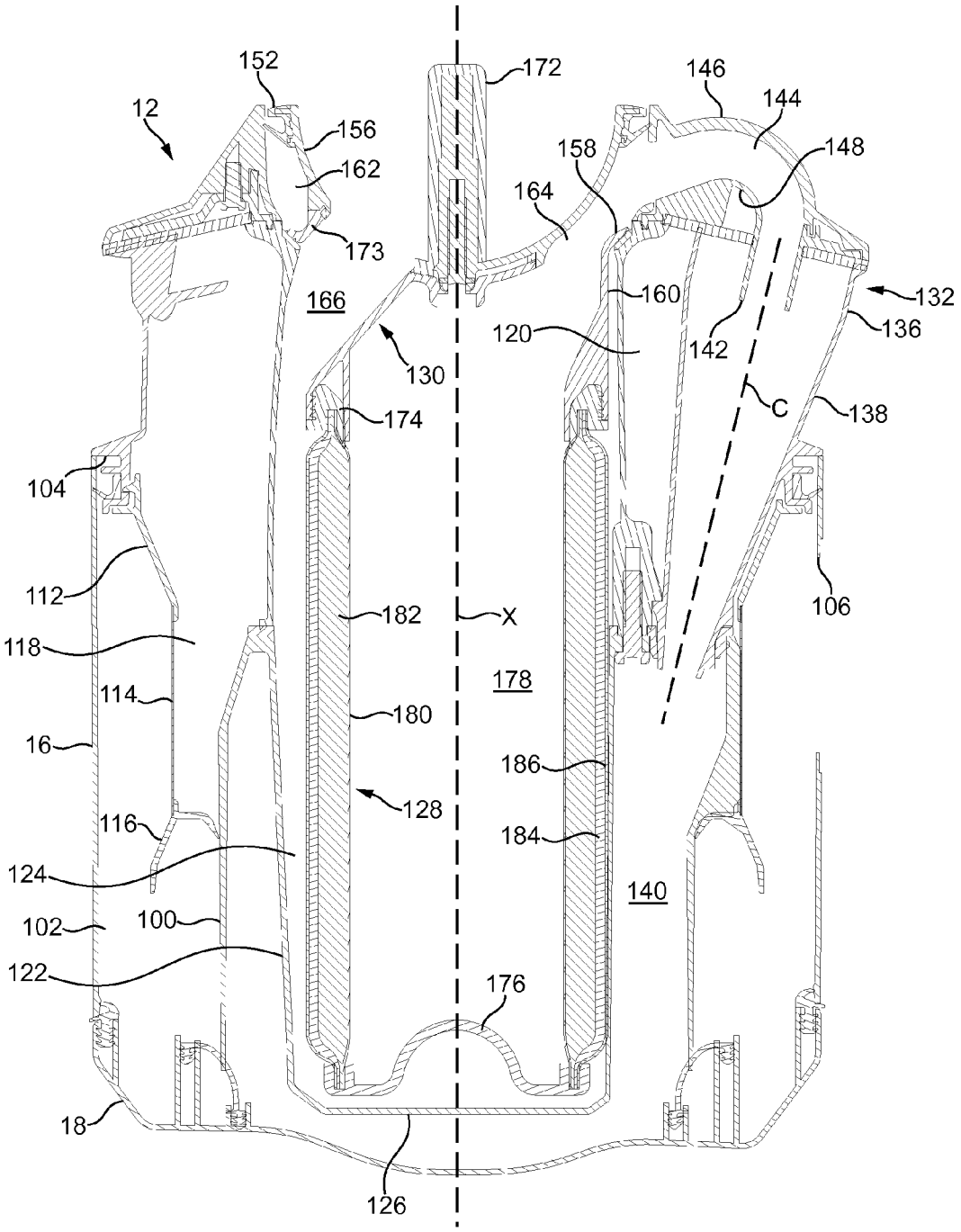
Figure 14C:
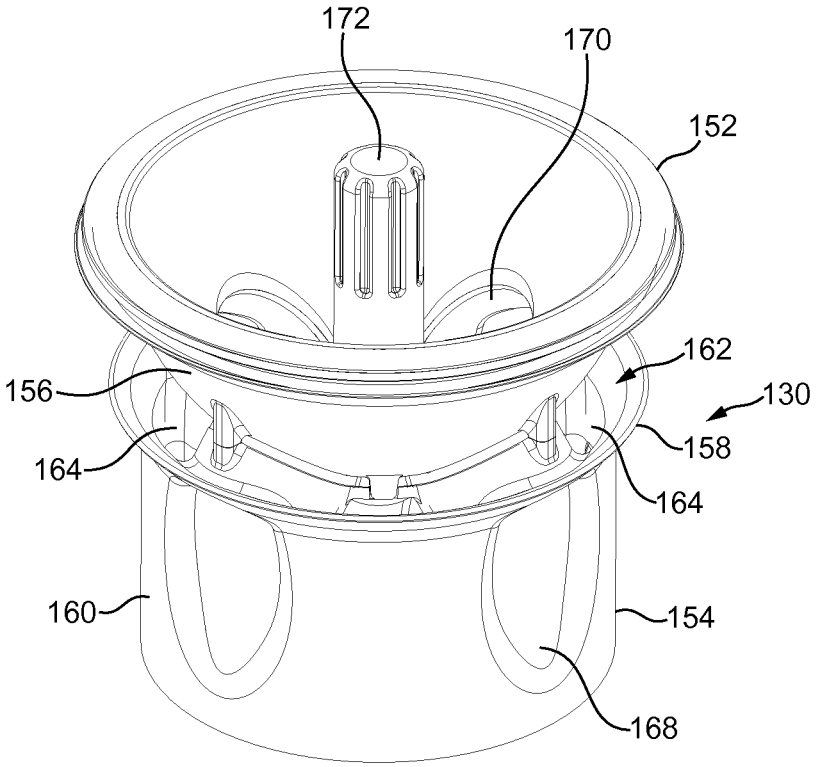

With particular reference to FIG. 14(*b*), the separating apparatus further comprises a second cylindrical wall 100. The second cylindrical wall 100 is located radially inwardly of the outer wall 16 and spaced therefrom so as to form an annular chamber 102 therebetween. The second cylindrical wall 100 meets the base 18 (when the base 18 is in the closed position) and is sealed thereagainst. The annular chamber 102 is delimited generally by the outer wall 16, the second cylindrical wall 100, the base 18 and an upper wall 104 positioned at the upper end of the outer bin 14.

A dirty air inlet 106 is provided at the upper end of the outer bin 14 below the upper wall 104 for receiving an air flow from the outlet 92 of the inlet duct 28. The dirty air inlet 106 is arranged tangentially to the outer bin 14 (as shown in FIG. 6) so as to ensure that incoming dirty air is forced to follow a helical path around the annular chamber 102. The dirty air inlet 106 receives the air flow from a conduit 108 connected to the outer wall 16 of the outer bin 14, for example by welding. The conduit 108 has an inlet 110 which is substantially the same size as the outlet 92 of the inlet duct 28, and which is located over the outlet 92 when the separating apparatus 12 is mounted on the support 74.

A fluid outlet is provided in the outer bin 14 in the form of a shroud. The shroud has an upper portion 112 formed in a frusto-conical shape, a lower cylindrical wall 114 and a skirt portion 116 depending therefrom. The skirt portion 116 tapers outwardly from the lower cylindrical wall 114 in a direction towards the outer wall 16. A large number of perforations are formed in the upper portion 112 of the shroud and in the cylindrical wall 114 of the shroud. The only fluid outlet from the outer bin 14 is formed by the perforations in the shroud. A passage 118 is formed between the shroud and the second cylindrical wall 100. The passage 118 communicates with a plenum chamber 120. The plenum chamber 120 is arranged radially outwardly of the shroud and located above the upper portion 112 of the shroud.

A third, generally cylindrical, wall 122 extends from adjacent the base 18 to a portion of the outer wall of the plenum chamber 120 and forms a generally cylindrical chamber 124. The lower end of the cylindrical chamber 124 is closed by an end wall 126. The cylindrical chamber 124 is shaped to accommodate a removable filter assembly 128 comprising a cross-over duct assembly 130, which are described in more detail below. The filter assembly 128 is removably received within the cylindrical chamber 124 so that there is no relative rotation of the filter assembly 128 relative to the remainder of the separating apparatus 12 during use of the vacuum cleaner 10. For example, the separating apparatus 12 may be provided with one or more slots which receive formations formed on the filter assembly 128 as the filter assembly 128 is inserted into the separating apparatus 12.

Arranged circumferentially around the plenum chamber 120 is a plurality of cyclones 132 arranged in parallel with one another. Referring to FIGS. 14(*a*) and 14(*b*), each cyclone 132 has a tangential inlet 134 which communicates with the plenum chamber 120. Each cyclone 132 is identical to the other cyclones 132 and comprises a cylindrical upper portion 136 and a tapering portion 138 depending therefrom. The tapering portion 138 of each cyclone 132 is frusto-conical in shape and terminates in a cone opening. The cyclone 132 extends into and communicates with an annular region 140 which is formed between the second and third cylindrical walls 100, 122. A vortex finder 142 is provided at the upper end of each cyclone 132 to allow air to exit the cyclone 132. Each vortex finder 142 communicates with a manifold finger 144 located above the cyclone 132. In the preferred embodiment there are twelve cyclones 132 and twelve manifold fingers 144. The twelve cyclones 132 are arranged in a ring which is centred on a longitudinal axis X of the outer bin 14. Each cyclone 132 has an axis C which is inclined downwardly and towards the axis X. The axes C are all inclined to the axis X at the same angle. The twelve cyclones 132 can be considered to form a second cyclonic separating unit, with the annular chamber 102 forming the first cyclonic separating unit.

In the second cyclonic separating unit, each cyclone 132 has a smaller diameter than the annular chamber 102 and so the second cyclonic separating unit is capable of separating finer dirt and dust particles than the first cyclonic separating unit. It also has the added advantage of being challenged with an airflow which has already been cleaned by the first cyclonic separating unit and so the quantity and average size of entrained particles is smaller than would otherwise have been the case. The separation efficiency of the second cyclonic separating unit is higher than that of the first cyclonic separating unit.

Each manifold finger 144 is a generally inverted U shape and is bounded by an upper wall 146 and lower wall 148 of a manifold 150 of the second cyclonic separating unit. The manifold finger 144 extends from the upper end of each cyclone 132 to the cross-over duct assembly 130.

With particular reference to FIG. 14(*c*), the cross-over duct assembly 130 comprises an annular seal 152 and a cross-over duct 154. The removable filter assembly 128 is located below the cross-over duct 154, within the cylindrical chamber 124. In the preferred embodiment the seal 152 is rubber, and is secured around the outer surface of the cross-over duct 154 with a friction fit. The cross-over duct 154 comprises an upper portion and a lower portion. The seal 152 is located on the upper portion of the cross-over duct 154. The upper portion of the cross-over duct 154 comprises a generally cup shaped portion 156 which provides a fluid outlet from the separating apparatus 12, and which has a convex outer surface, preferably of spherical curvature. The lower portion of the cross-over duct 154 comprises a lip 158 and a generally cylindrical outer housing 160 shaped to correspond to the size and shape of the cylindrical chamber 124. The lip 158 is shaped to have a diameter slightly larger than that of the cylindrical outer housing 160 and is located towards the upper end of the cylindrical outer housing 160. An inlet chamber 162 is formed between the upper portion and the lower portion of the cross-over duct 154. The inlet chamber 162 is bounded by the lower surface of the cup shaped portion 156, the upper surface of the cylindrical outer housing 160 and the lip 158. With reference to FIG. 14(*b*), the outlet of each manifold finger 144 terminates at the inlet chamber 162 of the cross-over duct assembly 130.

The cross-over duct 154 comprises a first set of ducts in which air passes in a first direction through the cross-over duct 154, and a second set of ducts in which air passes in a second direction, different from the first direction, through the cross-over duct 154. In this embodiment, eight ducts are located within the cylindrical outer housing 160 of the cross-over duct 154. These ducts comprise a first set of four filter inlet ducts 164, and a second set of four filter outlet ducts 166. The filter inlet ducts 164 are arranged in an annular formation which is centred on the axis X and in which the filter inlet ducts 164 are evenly spaced. The filter outlet ducts 166 are similarly evenly arranged and spaced about the axis X, but are located between the filter inlet ducts 164, preferably being angularly offset from the filter inlet ducts 164 by an angle of around 45 degrees.

Each filter inlet duct 164 has an inlet opening located towards the upper surface of the cylindrical outer housing 160 and adjacent the inlet chamber 162, and an outlet opening located towards the base of the cylindrical outer housing 160. Each filter inlet duct 164 thus comprises a passage extending between the inlet opening and the outlet opening. The passage has a smoothly changing cross-section for reducing noise and turbulence in the airflow passing through the cross-over duct 154.

Each filter outlet duct 166 comprises an inlet opening 168 in the outer surface of the cylindrical outer housing 160 adjacent the cylindrical chamber 124, and an outlet opening 170 for ducting cleaned air away from the filter assembly 128 and towards the outlet duct 30. Each filter outlet duct 166 thus comprises a passage extending between the inlet opening 168 and the outlet opening 170, and which passes through the cylindrical outer housing 160 from the outer surface of the cylindrical outer housing 160 towards the axis X. Consequently, the outlet opening 170 is located closer to the axis X than the inlet opening 168. The outlet opening 170 is preferably circular in shape.

The cup shaped portion 156 of the cross-over duct 154 comprises a graspable pillar 172 for allowing a user to pull the filter assembly 128 from the separating apparatus 12 for cleaning. The graspable pillar 172 is arranged to upstand from the base of the cup shaped portion 156 along the axis X so that it extends proud of the second cyclonic separating unit. The cross-over duct 154 also comprises a plurality of side lugs 173 arranged to depend from the lower surface of the cup portion 166 and which act to support the upper portion of the cross-over duct 164 on the lower portion.

Figure 15:
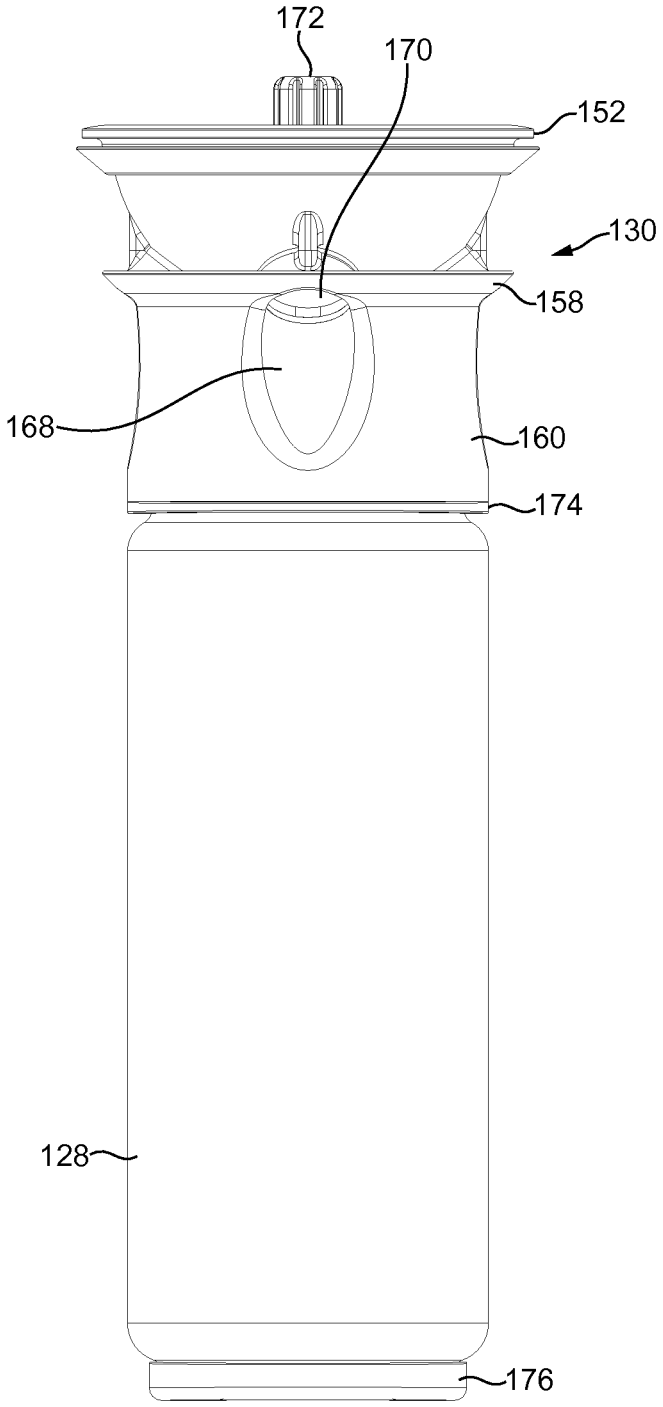
FIG. 15 is a side view of a filter of the separating apparatus of FIG. 12.
Figure 16:
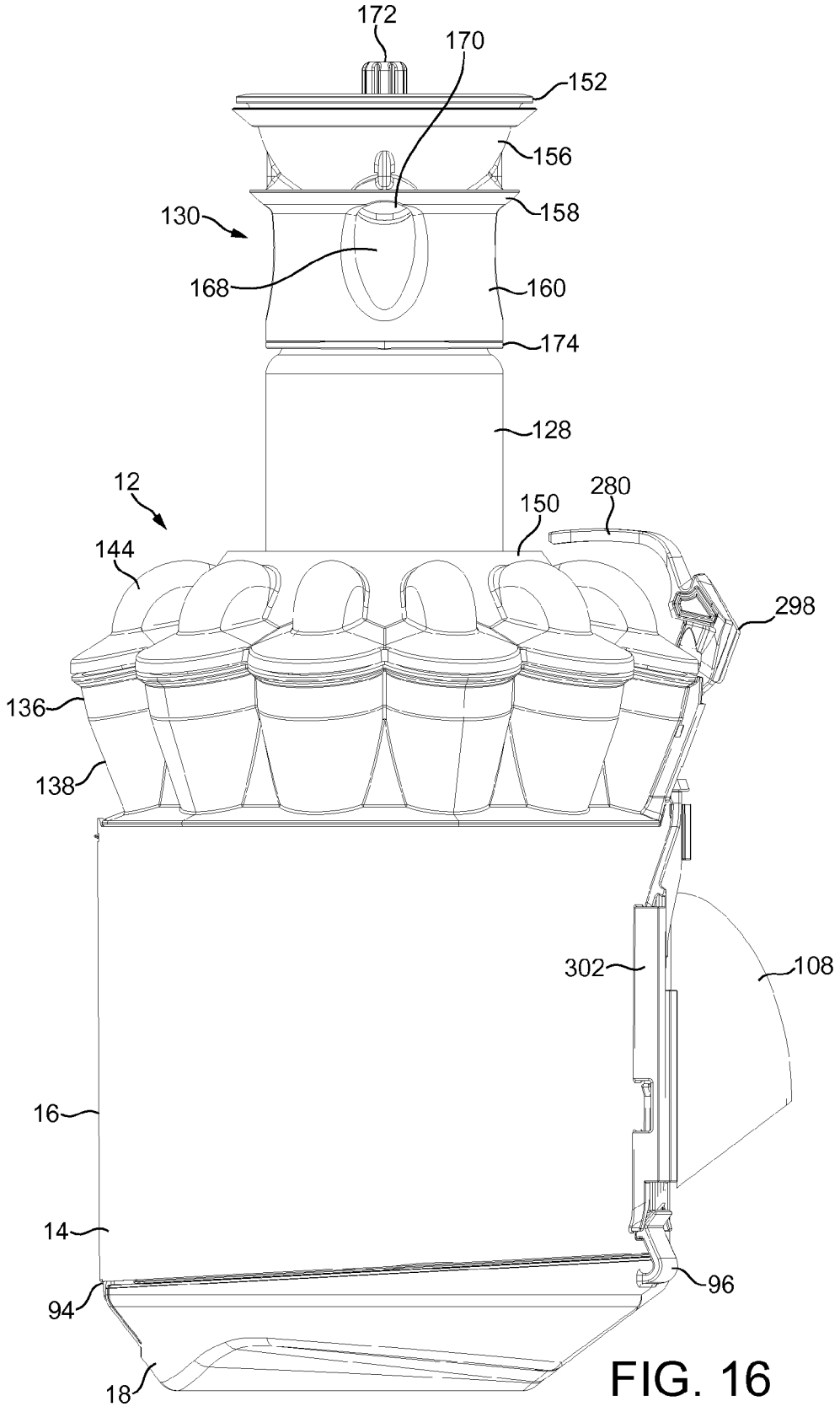
FIG. 16 is a side view of the separating apparatus of FIG. 12, with the filter of FIG. 15 partially removed therefrom.

Returning to FIG. 14(*b*), and with reference also to FIGS. 15 and 16, the filter assembly 128 comprises an upper rim 174, a base 176, and four cylindrical filter members located between the rim 174 and the base 176. The filter assembly 128 is generally cylindrical in shape, and comprises an inner chamber 178 bounded by the rim 174, the base 176 and an innermost, first filter member 180 of the filter assembly 128. The rim 174 is retained within an annular groove located in the lower portion of the cross-over duct 154.

The filter assembly 128 is constructed such that it is pliable, flexible and resilient. The rim 174 is annular in shape having a width, W, in a direction perpendicular to the axis X. The rim 174 is manufactured from a material with a hardness and deformability that enable a user to deform the rim 174 (and thus the filter assembly 128) by pressing or grasping the rim 174, and twisting or squeezing the filter assembly 128 by hand, in particular during a washing operation. In this embodiment, the rim 174 and base 176 are formed from polyurethane.

Each filter member of the filter assembly 128 is manufactured with a rectangular shape. The four filter members are then joined and secured together along their longest edge by stitching, gluing or other suitable technique so as to form a pipe length of filter material having a substantially open cylindrical shape, with a height, H, in the direction of the axis X. An upper end of each cylindrical filter member is then bonded to the rim 174, whilst a lower end of each filter member is bonded to the base 176, preferably by over-moulding the polyurethane material of the rim 174 and base 176 during manufacture of the filter assembly 128. Alternative manufacturing techniques for attaching the filter members include gluing, and spin-casting polyurethane around the upper and lower ends of the filter members. In this way the filter members are encapsulated by polyurethane during the manufacturing process to produce a strengthened arrangement capable of withstanding manipulation and handling by a user, particularly during washing of the filter assembly 128.

The first filter member 180 comprises a layer of scrim or web material having an open weave or mesh structure. A second filter member 182 surrounds the first filter member 180, and is formed from a non-woven filter medium such as fleece. The shape and volume of the second filter member 182 is selected so as to substantially fill the volume delimited by the width W of rim 174 and the height, H, of the filter assembly 128 as measured along the axis X. Therefore, the width of the second filter member 182 is substantially the same as the width W of the rim 174.

A third filter member 184 surrounds the second filter member 182, and comprises an electrostatic filter medium covered on both sides by a protective fabric. The layers are held together in a known manner by stitching or other sealing means. A fourth filter member 186 surrounds the third filter member 184, and comprises a layer of scrim or web material having an open weave or mesh structure.

During manufacture an upper part of the first filter member 180 is bonded to the rim 174 and the base 176 immediately adjacent the second filter member 182. An upper part of the third filter member 184 is bonded to the rim 174 and the base 176 immediately adjacent the second filter member 182, and an upper part of the fourth filter member 186 is bonded to the rim 174 and the base 176 immediately adjacent the third filter member 184. In this manner the filter members 180, 182, 184, 186 are held in position in the filter assembly 128 with respect to the rim 174 and the base 176 such that an airflow will impinge first on the first filter member, before impinging, in turn, on the second, third and fourth filter members. For the third filter member 184, comprising an electrostatic filter medium covered on both sides by a protective fabric, it is preferred that all of the layers of the third filter member 184 are bonded to the rim 174 and the base 176 so that the risk of delamination of the third filter member 184 during use is reduced.

The outlet duct 30 will now be described with reference to FIG. 6, 21(*a*) and 21(*b*). The outlet duct 30 comprises a generally curved arm spanning the separating apparatus 12 and the rolling assembly 20. The outlet duct 30 comprises a fluid inlet in the form of a ball joint 188 having a convex outer surface, and an elongate tube 190 for receiving air from the ball joint 188. The elongate tube 190 provides a passage 192 for conveying air from the separating apparatus 12 to the rolling assembly 20. With reference to FIG. 6, the pivot axis P passes through the outlet duct 30, preferably through the ball joint 188 of the outlet duct 30.

The ball joint 188 is generally hemispherical in shape and is removably locatable in the cup portion 156 of the cross-over duct 154, which is exposed through the open upper end of the manifold 150. A ball and socket joint is thus formed between the separating apparatus 12 and the outlet duct 30. The ball joint 188 comprises a flexible annular seal 194 extending thereabout, and which includes a lip 196 for engaging with an inner surface of the cup portion 156 of the cross-over duct 154. This facilitates efficient and robust sealing between the ball joint 188 and the cross-over duct 154. Alternatively the outer surface of the ball joint 188 may include features, such as an outwardly directed ledge, flange or ribs, which engage with the cup portion 156 of the cross-over duct 154. In addition, in the preferred embodiment the seal 152 of the cross-over duct assembly 130 is flexible and shaped such that the diameter of the upper portion of the seal 152 is slightly smaller that the diameter of the ball joint 188 to provide a snug, elastic fit around the outer surface of the ball joint 188. The seal 152 can also seal any gaps between the ball joint 188 and the second cyclonic separating unit.

As described previously, rotation of the inlet duct 28 about axis P during a cleaning operation causes the separating apparatus 12 to swing about axis P relative to the outlet duct 30. As shown in FIG. 6, the seal 196 and the fit of the upper rim of the seal 152 with the ball joint 188 facilitate a continuous fluid connection between the (fixed) outlet duct passage 192 and the (moveable) outlet openings 170 of the cross-over duct 154. Consequently, an air tight connection is maintained between the separating apparatus 12 and the outlet duct 30 as the separating apparatus 12 moves relative to the outlet duct 30 during movement of the vacuum cleaner 10 across a floor surface.

Figure 22:
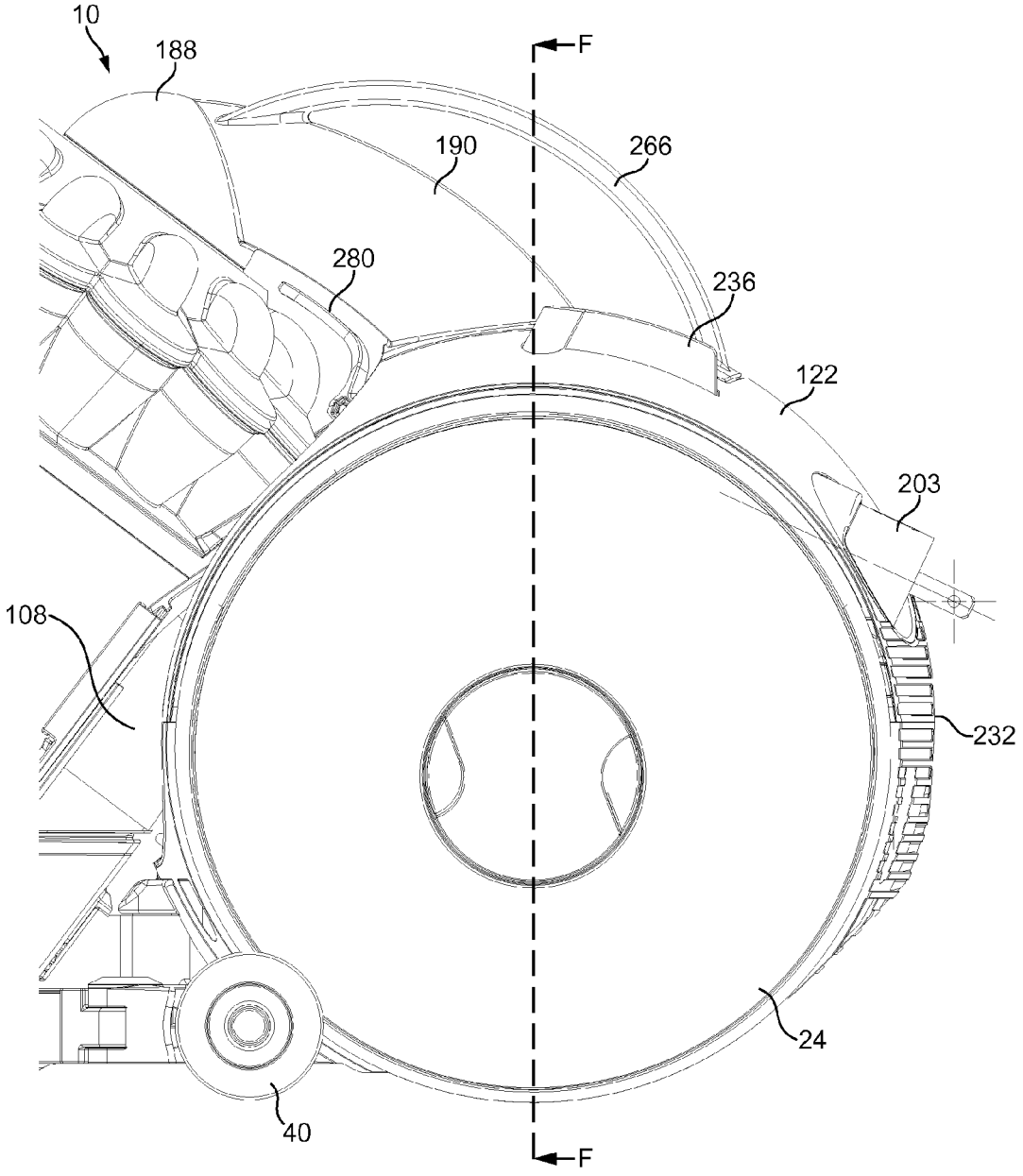
FIG. 22 is an enlarged side view of the main body of the vacuum cleaner of FIG. 1.
Figure 23:
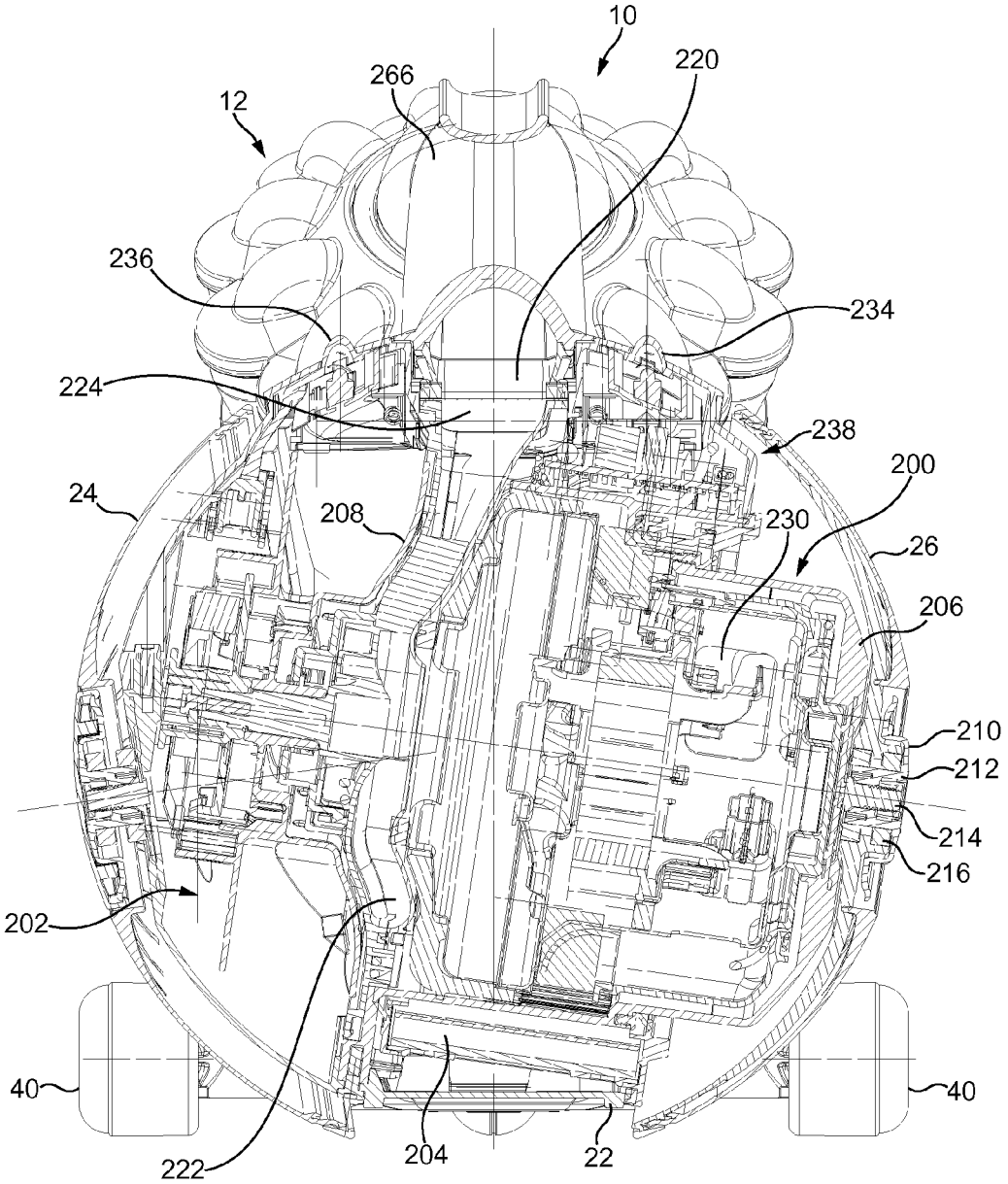
FIG. 23 is a sectional view taken along line F-F in FIG. 22.

The rolling assembly 20 will now be described with reference to FIGS. 22 and 23. The rolling assembly 20 comprises a main body 22 and two curved wheels 24, 26 rotatably connected to the main body 22 for engaging a floor surface. In this embodiment the main body 22 and the wheels 24, 26 define a substantially spherical rolling assembly 20. The rotational axes of the wheels 24, 26 are inclined upwardly towards the main body 22 with respect to a floor surface upon which the vacuum cleaner 10 is located so that the rims of the wheels 24, 26 engage the floor surface. The angle of the inclination of the rotational axes of the wheels 24, 26 is preferably in the range from 5 to 15°, more preferably in the range from 6 to 10°, and in this embodiment is around 8°. Each of the wheels 24, 26 of the rolling assembly 20 is dome-shaped, and has an outer surface of substantially spherical curvature, so that each wheel 24, 26 is generally hemispherical in shape. In the preferred embodiment, the diameter of the external surface of each wheel 24, 26 is smaller than the diameter of the rolling assembly 20, and is preferably in the range from 80 to 90% of the diameter of the rolling assembly 20.

The rolling assembly 20 houses a motor-driven fan unit 200, a cable rewind assembly 202 for retracting and storing within the main body 22 a portion of an electrical cable (not shown) terminating in a plug 203 providing electrical power to, inter alia, the motor of the fan unit 200, and a filter assembly 204. The fan unit 200 comprises a motor, and an impeller driven by the motor to drawn the dirt-bearing airflow into and through the vacuum cleaner 10. The fan unit 200 is housed in a motor bucket 206. The motor bucket 206 is connected to the main body 22 so that the fan unit 200 does not rotate as the vacuum cleaner 10 is manoeuvred over a floor surface. The filter assembly 204 is located downstream of the fan unit 200. The filter assembly 204 is cuff shaped and located around a part of the motor bucket 206. A plurality of perforations 207 is formed in a portion of the motor bucket 206 which is surrounded by the filter assembly 204.

A seal 208 separates the cable rewind assembly 202 from the motor bucket 206. The seal 208 facilitates the division of the main body 22 into a first region including the fan unit 200, which will generate heat during use, and a second region accommodating the cable rewind assembly 202, for which heat is detrimental and which may require cooling during use.

The filter assembly 204 may be periodically removed from the rolling assembly 20 to allow the filter assembly 204 to be cleaned. The filter assembly 204 is accessed by removing the wheel 26 of the rolling assembly 20. This wheel 26 may be removed, for example, by the user first twisting an end cap 210 mounted on the wheel 26 to disengage a wheel mounting sleeve 212 located over the end of an axle 214 connected to the motor bucket 206. The wheel mounting sleeve 212 may be located between the axle 214 and a wheel bearing arrangement 216. The wheel 26 may then be pulled from the axle 214 by the user so that the wheel mounting sleeve 212, wheel bearing arrangement 216 and end cap 210 come away from the axle 214 with the wheel 26. The filter assembly 204 may then be removed from the rolling assembly 20 by depressing a catch 218 connecting the filter assembly 204 to the motor bucket 206, and pulling the filter assembly 204 from the rolling assembly 20.

The main body 22 of the rolling assembly 20 further comprises a fluid inlet port 220, an annular shaped chamber 222 for receiving air from the inlet port 220, and a passage 224 bounded by the chamber 222. The chamber 222 is shaped such that there is a smooth change in cross sectional area of the airflow passing from the inlet port 220 to the fan unit 200. The chamber 222 facilitates a change in direction of the passage 224 of around 90 degrees. A smooth path and a smooth change in cross sectional area of a passage for airflow can reduce inefficiencies in the system, for example losses through the motor bucket 206. A grille may be located between the inlet port 220 and the motor chamber 222 to protect the fan unit 200 and motor bucket 206 from damage by objects that could otherwise enter, block and/or obstruct the motor chamber 222, for example during removal of the separating apparatus 12 from the main body 22, as described below.

The fan unit 200 comprises a series of exhaust ducts 230 located around the outer circumference of the fan unit 200. In the preferred embodiment four exhaust ducts 230 are arranged around the fan unit 200 and provide communication between the fan unit 200 and the motor bucket 206. The filter assembly 204 is located around the motor bucket 206, and the perforations 218 facilitate communication between the motor bucket 206 and the main body 22. The main body 22 further comprises an air exhaust port for exhausting cleaned air from the vacuum cleaner 10. The exhaust port is formed towards the rear of the main body 22. In the preferred embodiment the exhaust port comprises a number of outlet holes 232 located in a lower portion of the main body 22, and which are located so as to present minimum environmental turbulence outside of the vacuum cleaner 10.

A first user-operable switch 234 is provided on the main body and is arranged so that, when it is depressed, the fan unit 200 is energised. The fan unit 200 may also be de-energised by depressing this first switch 234. A second user-operable switch 236 is provided adjacent the first switch 234. The second switch 236 enables a user to activate the cable rewind assembly 202. Circuitry 238 for driving the fan unit 200 and cable rewind assembly 202 is also housed within the rolling assembly 20.

The main body 22 comprises a bleed valve 240 for allowing an airflow to be conveyed to the fan unit 200 in the event of a blockage occurring in, for example, the wand and hose assembly. This prevents the fan unit 200 from overheating or otherwise becoming damaged. The bleed valve 240 comprises a piston chamber 242 housing a piston 244. An aperture 246 is formed at one end of the piston chamber 242 for exposing the piston chamber 242 to the external environment via the outlet holes 232, and a conduit 248 is formed at the other end of the piston chamber 242 for placing the piston chamber 242 in fluid communication with the passage 224.

A helical compression spring 250 located in the piston chamber 242 urges the piston 244 towards an annular seat 252 inserted into the piston chamber 242 through the aperture 246. During use of the vacuum cleaner 10, the force $F_1$ acting on the piston 242 against the biasing force $F_2$ of the spring 250, due to the difference in the air pressure acting on each respective side of the piston 244, is lower than the biasing force $F_2$ of the spring 250, and so the aperture 246 remains closed. In the event of a blockage in the airflow path upstream of the conduit 248, the difference in the air pressure acting on the opposite sides of the piston 242 dramatically increases. The biasing force $F_2$ of the spring 250 is chosen so that, in this event, the force $F_1$ becomes greater than the force $F_2$, which causes the piston 244 to move away from the seat 252 to open the aperture 246. This allows air to pass through the piston chamber 242 from the external environment and enter the passage 224.

In use, the fan unit 200 is activated by the user, for example by pressing the switch 234, and a dirt-bearing airflow is drawn into the vacuum cleaner 10 through the suction opening in the cleaner head. The dirt-bearing air passes through the hose and wand assembly, and enters the inlet duct 28. The dirt-bearing air passes through the inlet duct 28 and enters the dirty air inlet 106 of the separating apparatus 12. Due to the tangential arrangement of the dirty air inlet 106, the airflow follows a helical path relative to the outer wall 16. Larger dirt and dust particles are deposited by cyclonic action in the annular chamber 102 and collected therein.

The partially-cleaned airflow exits the annular chamber 102 via the perforations in the shroud and enters the passage 118. The airflow then passes into the plenum chamber 120 and from there into one of the twelve cyclones 132 at inlet 134 wherein further cyclonic separation removes some of the dirt and dust still entrained within the airflow. This dirt and dust is deposited in the annular region 140 whilst the cleaned air exits the cyclones 132 via the vortex finders 142 and enters the manifold fingers 144. The airflow then passes into the cross-over duct 154 via the inlet chamber 162 and enters the four filter inlet ducts 164 of the cross-over duct 154. From the filter inlet ducts 164 the airflow enters the central open chamber 178 of the filter assembly 124.

The airflow passes through the central open chamber 178, and is forced tangentially outwardly towards the filter members of the filter assembly 124. The airflow enters first the first filter member 180, and then passes sequentially through the second filter member 182, the third filter member 184 and the fourth filter member 186, with dirt and dust being removed from the air flow as it passes through each filter member.

The airflow emitted from the filter assembly 128 passes into the cylindrical chamber 124 and is drawn into the filter outlet ducts 166 of the cross-over duct 154. The airflow passes through the filter outlet ducts 166 and exits the cross-over duct 154 through the four exit ports 170 in the cup portion 156 of the cross-over duct 154. The airflow enters the ball joint 188 of the outlet duct 30, passes along the passage 192 and enters the main body 22 of the rolling assembly 20 through the fluid inlet port 220.

Within the rolling assembly 20, the airflow passes sequentially through the grille and passage 224, and enters the chamber 222. The chamber 222 guides the airflow into the fan unit 200. The airflow is prevented from passing through the cable rewind assembly 202 by the seal 208. The airflow is exhausted from the motor exhaust ducts 230 into the motor bucket 206. The airflow then passes out of the motor bucket 206 in a tangential direction via the perforations 218 and passes through the filter assembly 204. Finally the airflow follows the curvature of the main body 22 to the outlet holes 232 in the main body 22, from which the cleaned airflow is ejected from the vacuum cleaner 10.

The outlet duct 30 is detachable from the separating apparatus 12 to allow the separating apparatus 12 to be removed from the vacuum cleaner 10. The end of the tube 190 remote from the ball joint 188 of the outlet duct 30 is pivotably connected to the main body 22 of the rolling assembly 20 to enable the outlet duct 30 to be moved between a lowered position, shown in FIG. 2, in which the outlet duct 30 is in fluid communication with the separating apparatus 12, and a raised position, shown in FIG. 21(*a*), which allows the separating apparatus 12 to be removed from the vacuum cleaner 10.

Figure 4:
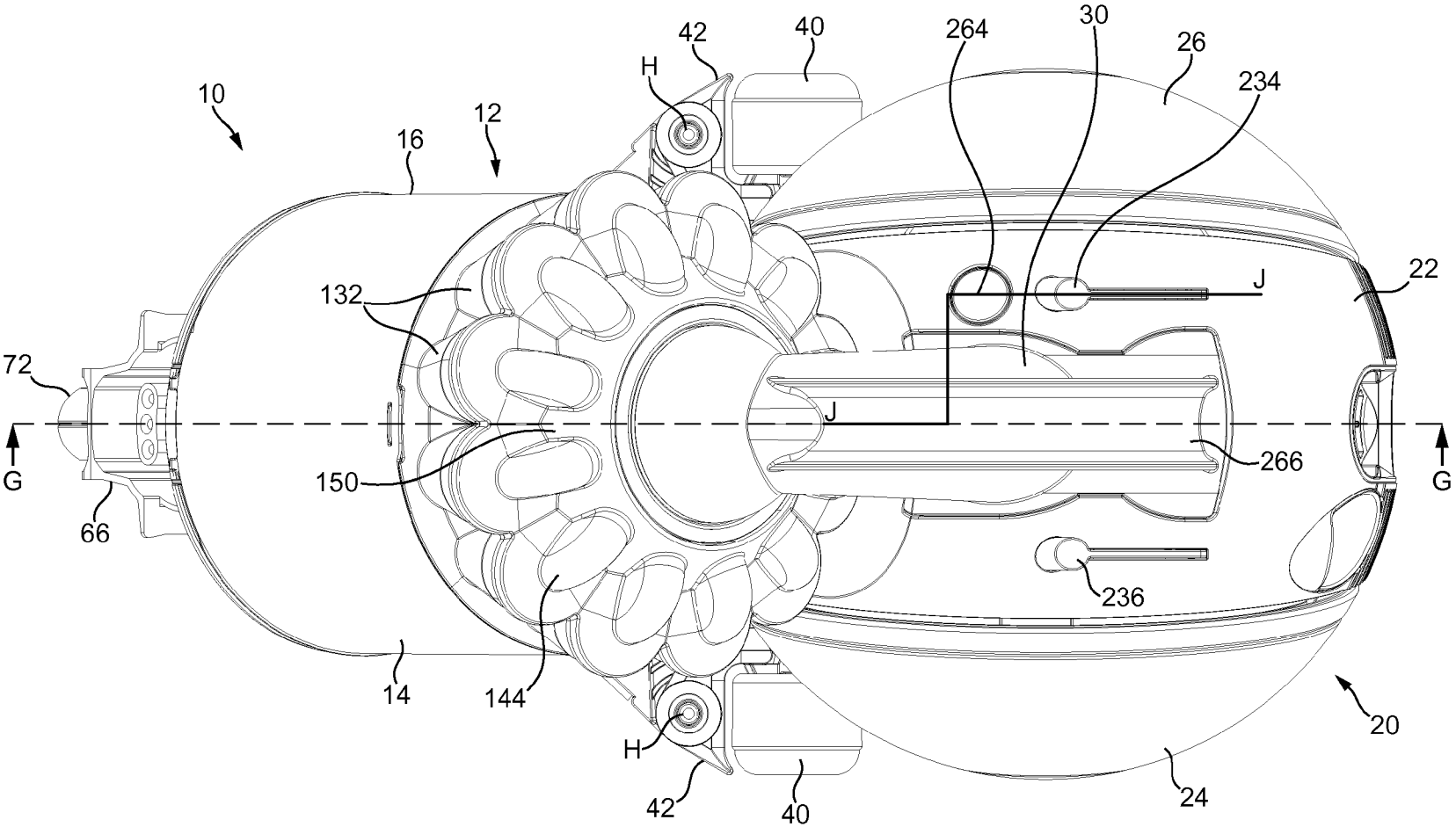
FIG. 4 is a top view of the vacuum cleaner of FIG. 1.

With reference again to FIGS. 21(*a*) and 21(*b*), and also to FIG. 4, the outlet duct 30 is biased towards the raised position by a spring 260 located in the main body 22. The main body 22 also comprises a catch 262 for retaining the outlet duct 30 in the lowered position against the force of the spring 260, and a catch release button 264. The outlet duct 30 comprises a handle 266 to allow the vacuum cleaner 10 to be carried by the user when the outlet duct 30 is retained in its lowered position. In the preferred embodiment the spring 260 is a torsion spring provided in engagement with a portion of the handle 266. The catch 262 is located on the main body 22 proximate the outlet duct 30 and along the line G-G in FIG. 4.

The catch 262 is arranged to co-operate with a flange 268 of the outlet duct 30. The flange 268 depends from the underside of the outlet duct 30 and extends in a direction extending towards the main body 22. The flange 268 is located below a groove 270 shaped to accommodate an engaging member of the catch 262.

The catch 262 comprises a hook 272 and a rod 274. The rod 274 extends horizontally between the catch release button 264 and the catch 262. The hook 272 is arranged at an angle of 90 degrees to the rod 274, and is connected to an end of the rod 274 which is proximate the outlet duct 30. The hook 272 is sized so as to be accommodated within the groove 270 of the flange 268. The hook and rod assembly of the catch 262 is pivotably mounted on the main body 22 and arranged to rotate about pivot axis Q, which is substantially orthogonal to the pivot axis P of the separating apparatus 12.

The catch release button 264 comprises an upper surface which may be coloured or feature other indications of its function to highlight the catch release button 264 for a user. The catch release button 264 further comprises a pin 276 and a guide channel 278. The pin 276 depends downwardly from the upper surface of the catch release button 264, and is slidably mounted within the guide channel 278. The pin 276 is moveable along the guide channel 278 from an upper deactivation position to a lower activation position. In the activation position the pin 276 extends beyond the guide channel 278 and is arranged to impinge on the rod portion 274 of the catch 262.

In use, the filter assembly 128 is arranged in the airflow path of the vacuum cleaner 10, as described above. Through use, the filter assembly 128 can become clogged, causing a reduction in the filtration efficiency. In order to alleviate this, the filter assembly 128 will require periodic cleaning or replacement. In the preferred embodiment the filter assembly 128 and all of the filter members are capable of being cleaned by washing. The filter assembly 128 can be accessed by the user for cleaning when the outlet duct 30 is in its raised position. The pillar 172 of the filter assembly 128 extends beyond the manifold 150, and acts to prompt the user as to where the filter assembly 128 is located, thus aiding removal of the filter assembly 128. The user removes the filter assembly 128 from the separating apparatus 12 by the gripping the pillar 172, and pulling the pillar 172 outwardly and upwardly from the cylindrical chamber 124 of the separating apparatus 12. In this way, the user is not required to handle directly the clogged filter members of the filter assembly 128. This makes replacing or cleaning the filter assembly 128 a hygienic task. The filter assembly 128 is washed by rinsing under a household tap in a known manner and allowed to dry. The filter assembly 128 is then re-inserted into the cylindrical chamber 124 of the separating apparatus 12, the outlet duct 30 is moved to its lowered position and use of the vacuum cleaner 10 can continue.

To enable the outlet duct 30 to be moved from its lowered position to its raised position, the user depresses the catch release button 264. The movement of the catch release button 264 and the lowering of the pin 276 within the guide channel 278 causes a lower part of the pin 276 to impinge on the rod 274 of the catch 262. The rod 274 is forced away from the deactivated position and caused to rotate in an anticlockwise direction about pivot axis Q. The hook 272, being connected to the rod 274, is also caused to rotate in an anticlockwise direction about pivot axis Q and moves out of engagement with groove 270 of flange 268. The movement of the hook 272 of the catch 262 away from the flange 268 allows the biasing force of the spring 260 to urge the handle 266, and thus the outlet duct 30, away from the main body 22 and thereby swing the outlet duct 30 away from its lowered position toward its raised position.

Figure 17:
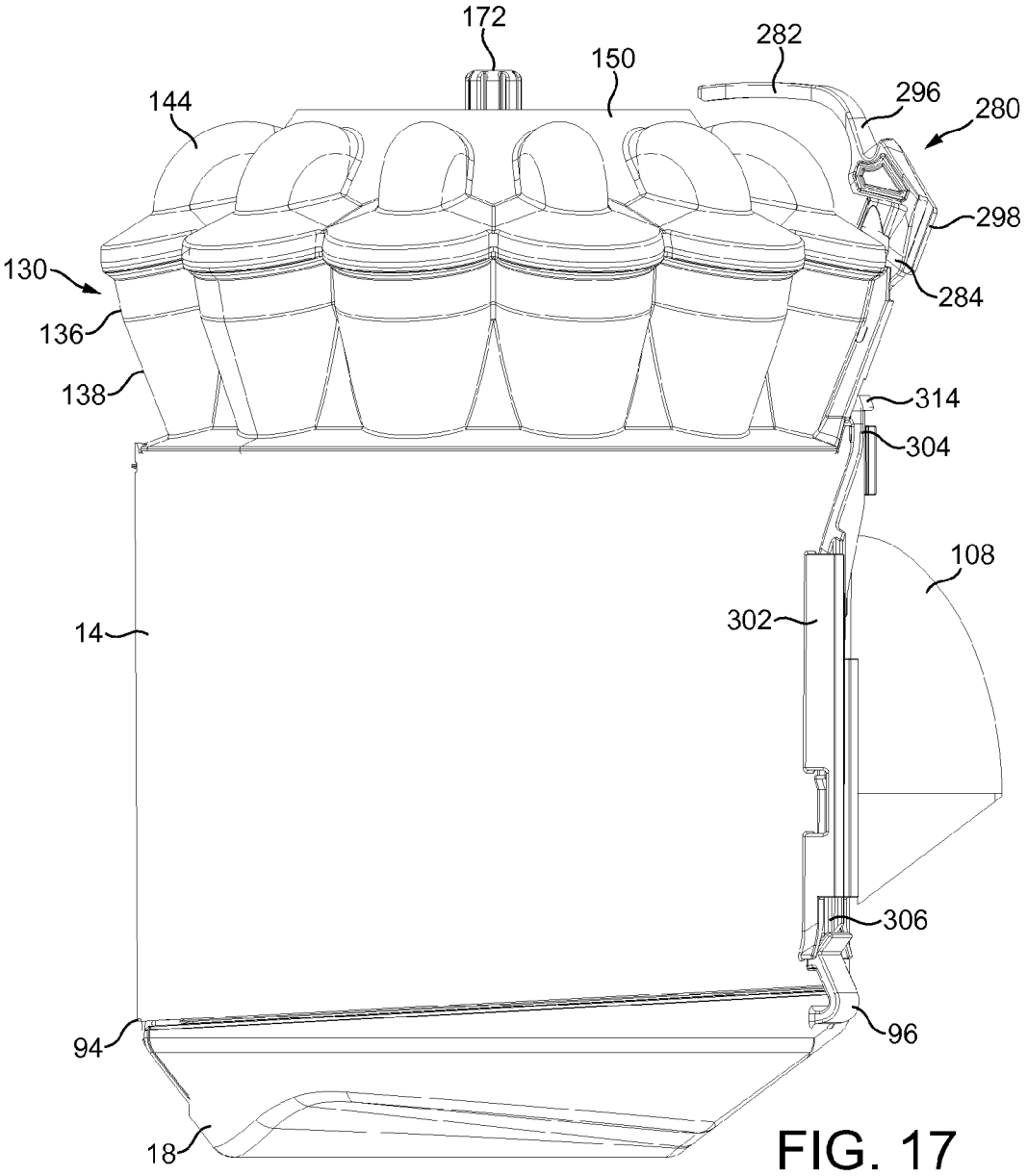
FIG. 17 is a side view of the separating apparatus of FIG. 12, with the filter of FIG. 15 fully inserted thereinto and with a handle of the separating apparatus in a stowed position.
Figure 18:
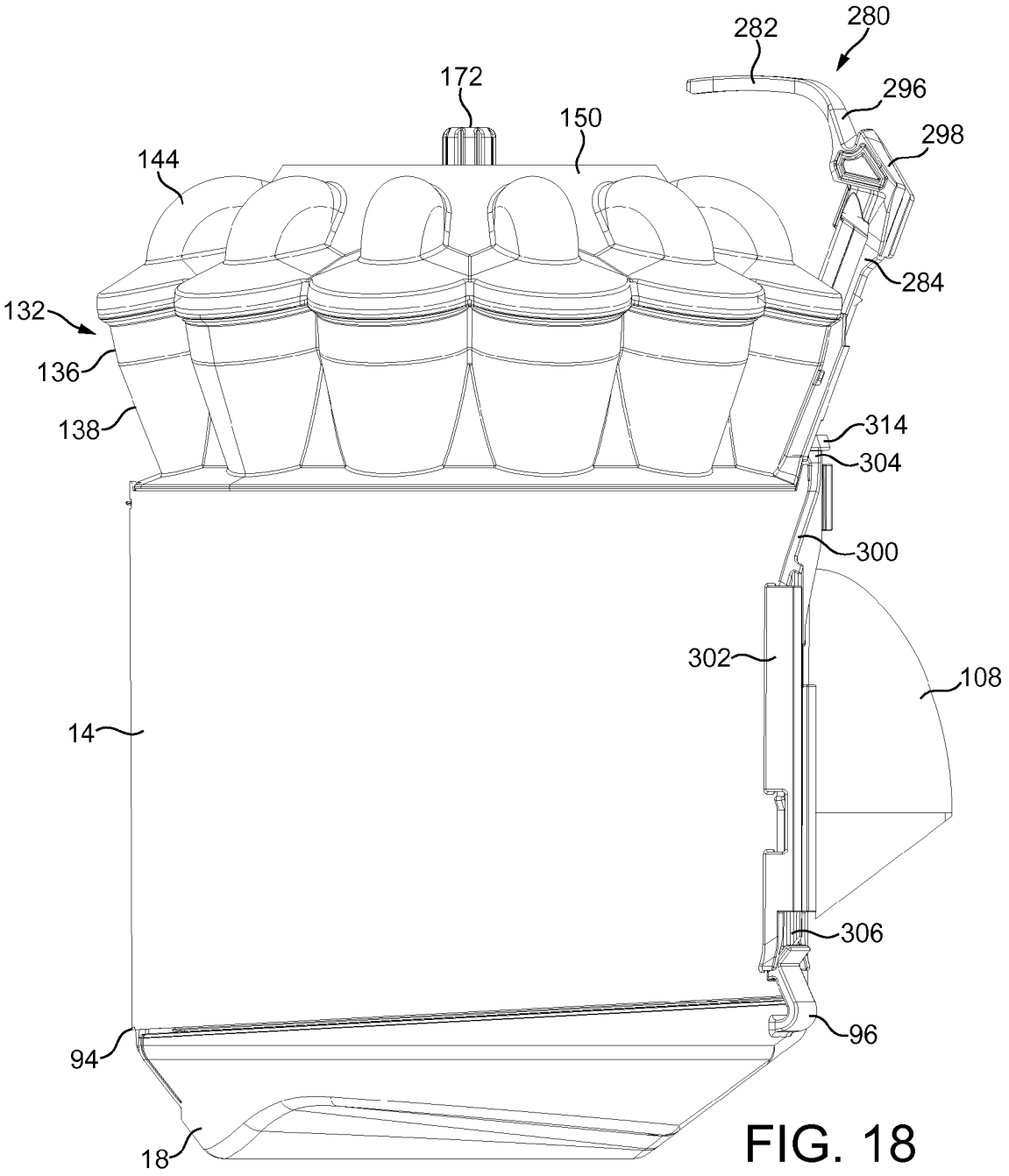
FIG. 18 is a side view of the separating apparatus of FIG. 12, with the filter of FIG. 15 fully inserted thereinto and with the handle of the separating apparatus in a deployed position.
Figure 19:
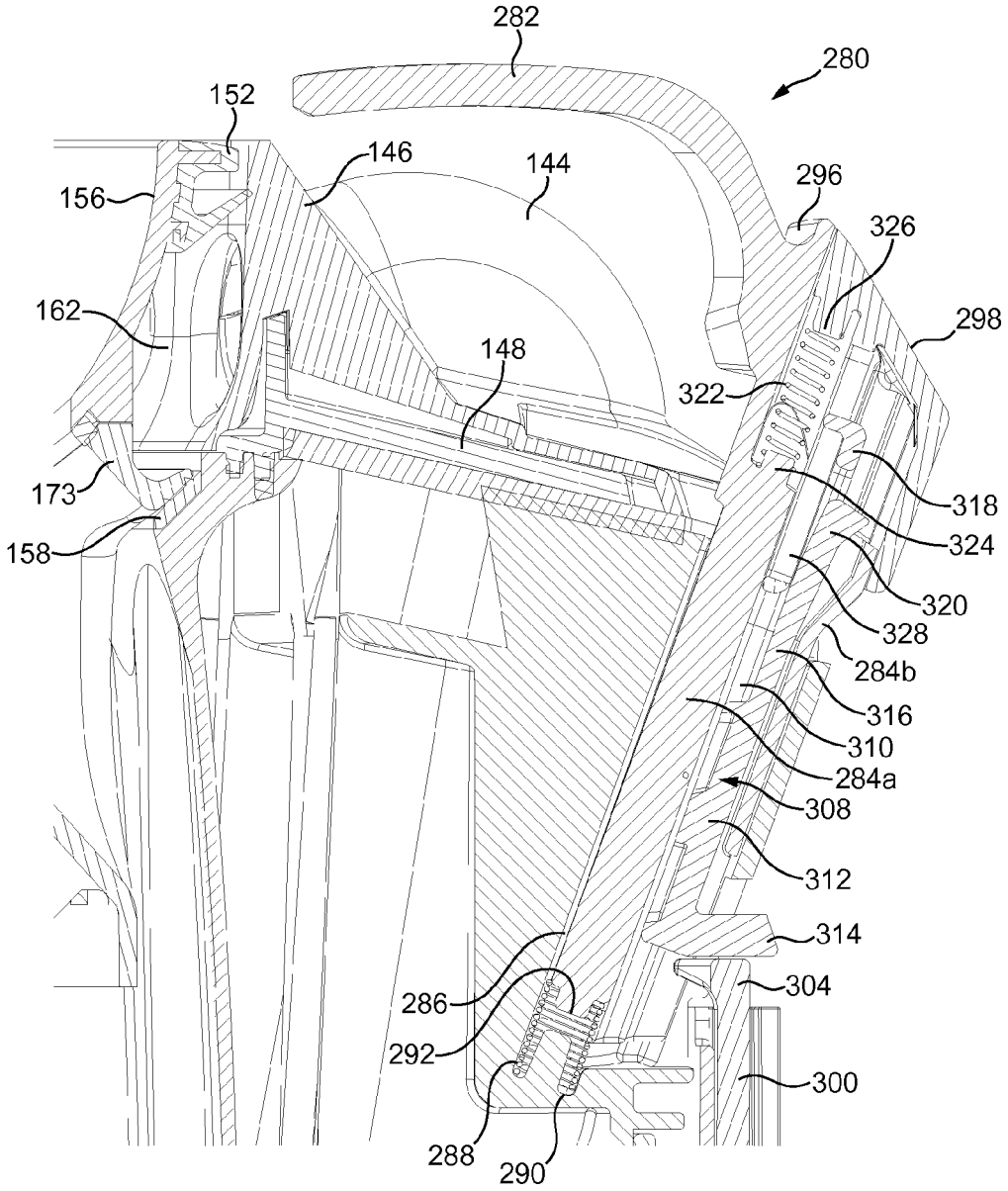
FIG. 19 is a sectional view of the handle of the separating apparatus of FIG. 12 in its stowed position.
Figure 20:
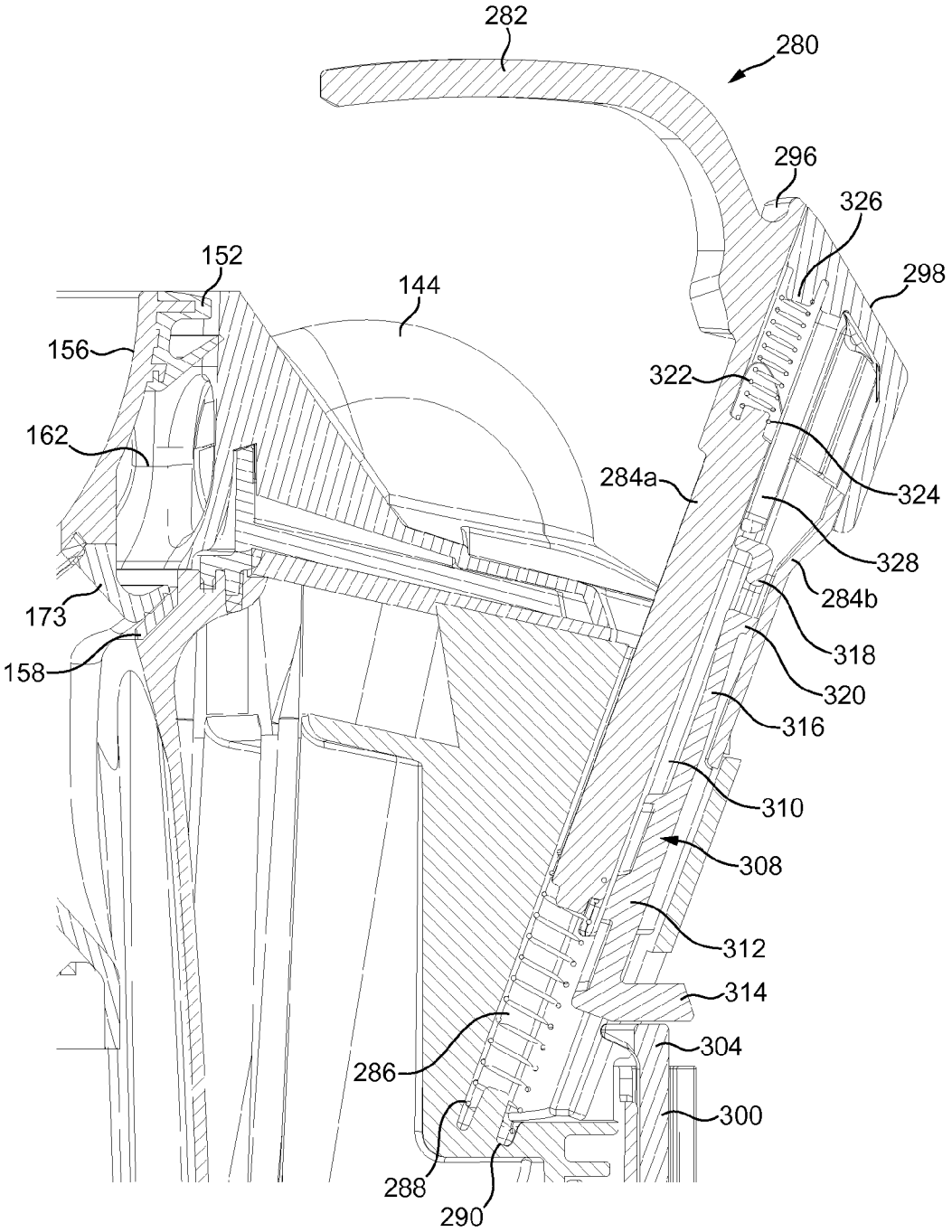
FIG. 20 is a sectional view of the handle of the separating apparatus of FIG. 12 in its deployed position.

When the outlet duct 30 is in its raised position, the separating apparatus 12 may be removed from the vacuum cleaner 10 for emptying and cleaning. The separating apparatus 12 comprises a handle 280 for facilitating the removal of the separating apparatus 12 from the vacuum cleaner 10. The handle 280 is positioned on the separating apparatus 12 so as to be located beneath the outlet duct 30 when the outlet duct 30 is in its lowered position. As discussed in more detail below, the handle 280 is moveable relative to the outer bin 14 of the separating apparatus 12 between a stowed position, as illustrated in FIGS. 17 and 19, and a deployed position, as illustrated in FIGS. 18 and 20, in which the handle 280 is readily accessible by the user. The extent of the movement of the handle 280 between its stowed and deployed positions is preferably in the range from 10 to 30 mm, and in this preferred embodiment is around 15 mm.

The handle 280 comprises a head 282 attached to an elongate body 284 which is slidably located within a recess 286 formed in the second cyclonic separating unit of the separating apparatus 12. The body 284 is located between two adjacent cyclones 132 of the second cyclonic separating unit, and is inclined at a similar angle to the axis X as the axes C of the cyclones 132. The body 284 comprises an inner portion 284*a*connected to the head 282, and an outer portion 284*b*. The head 280 is biased toward its deployed position by a resilient member located within the recess 286. In this embodiment, this resilient member comprises a first helical spring 288. The lower end of the first helical spring 288 engages the lower surface 290 of the recess 286, and the upper end of the first helical spring 288 engages the lower end 292 of the inner portion 284*a* of the body 284 so that the elastic energy stored in the first helical spring 288 urges the body 284 away from the lower surface 290 of the recess 286.

Figure 21A:
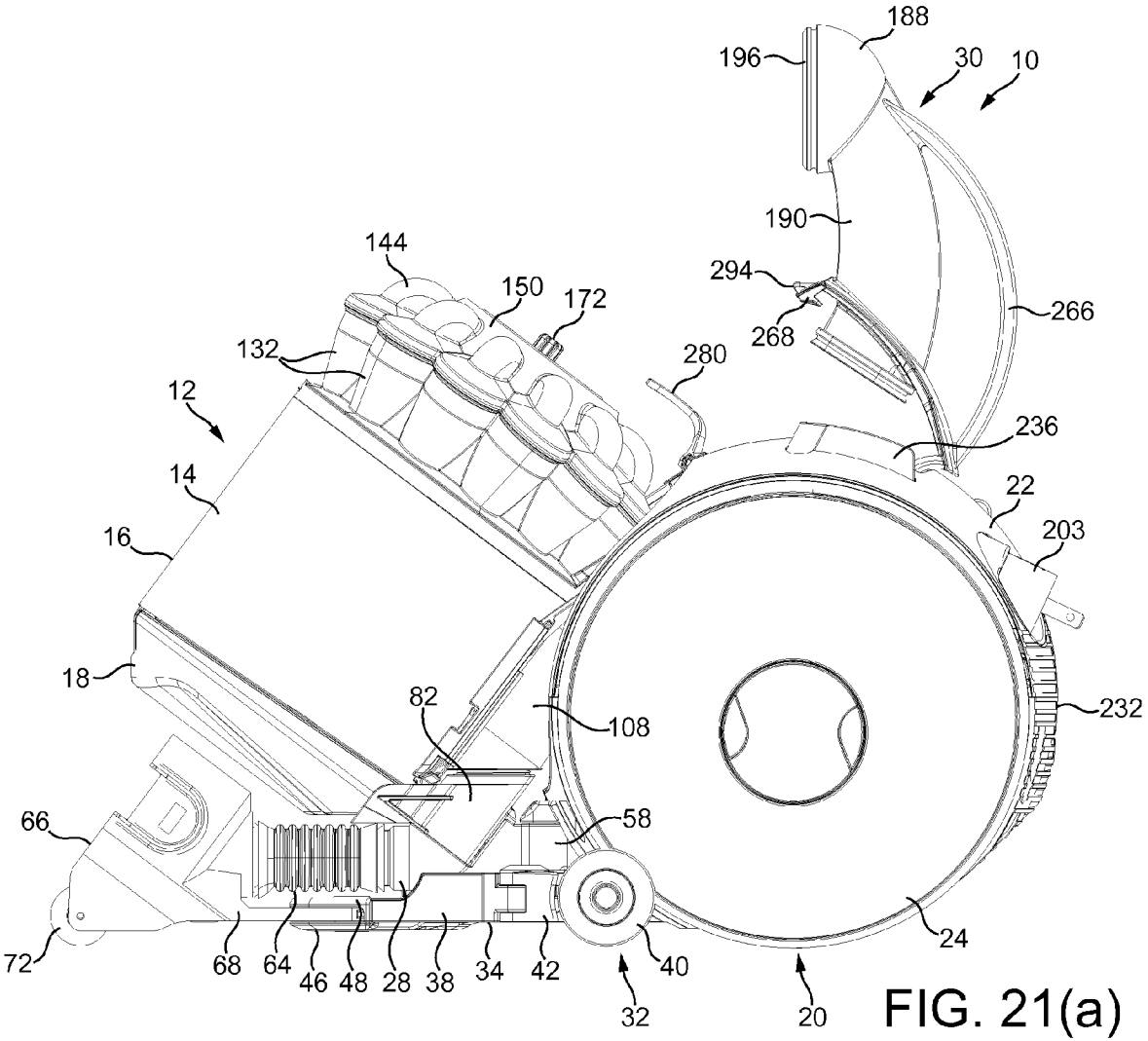
FIG. 21(*a*) is a side view of the vacuum cleaner of FIG. 1, with a duct extending from the separating apparatus to the main body in a raised position.
Figure 21B:
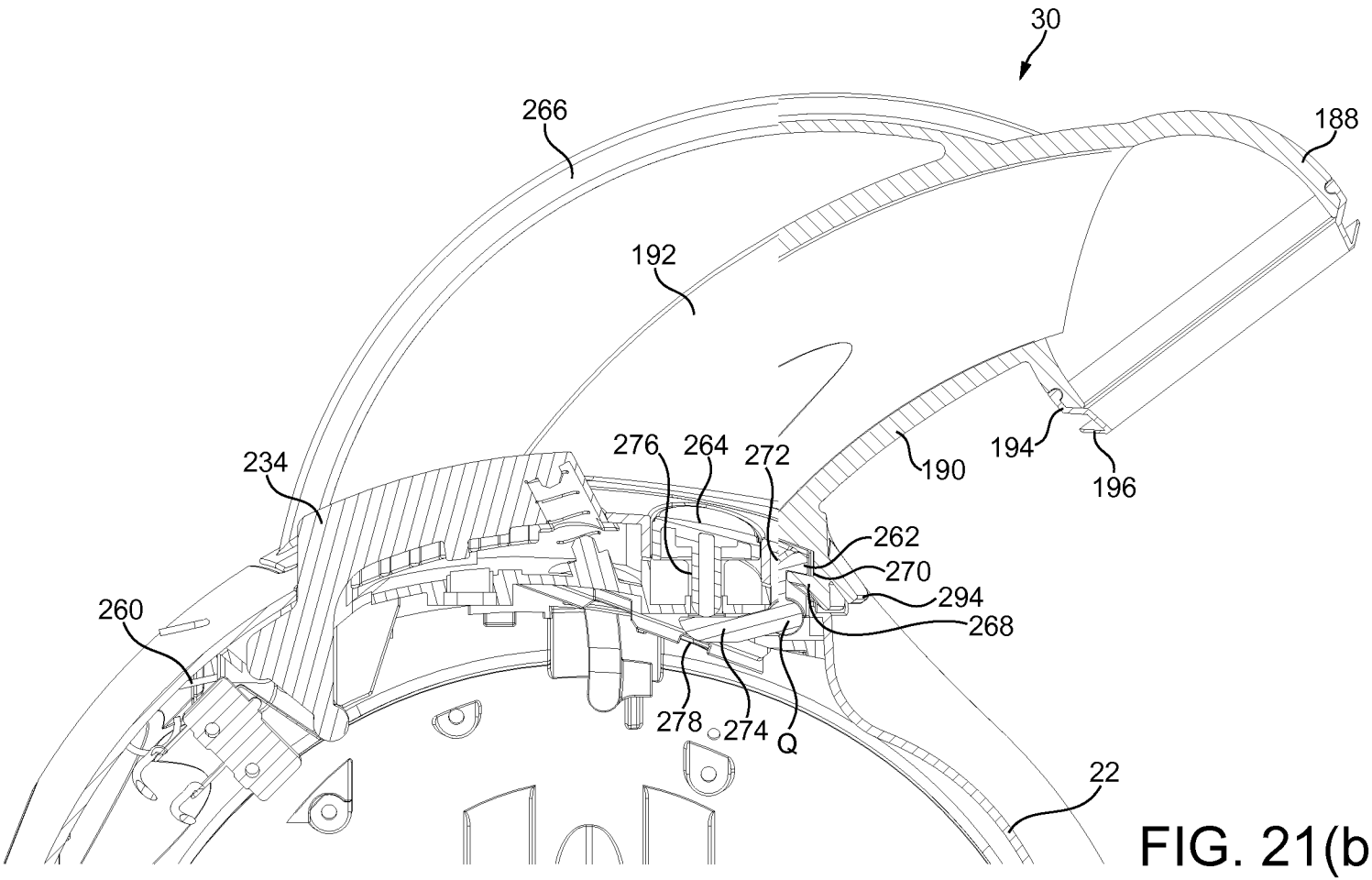

The handle 280 is urged towards its stowed position by the outlet duct 30. With reference to FIG. 21, the outlet duct 30 comprises a flange 294 depending downwardly therefrom for engaging the head 282 of the handle 280. Returning to FIGS. 17 to 20, the head 282 comprises a groove 296 for receiving the flange 294 of the outlet duct 30. When the outlet duct 30 is moved from its raised position, shown in FIG. 21, to its lowered position, shown in FIG. 2, the flange 294 locates within the groove 296 and pushes the handle 280 towards its stowed position against the biasing force of the first helical spring 288. Once the handle 280 has reached its stowed position, any further movement of the outlet duct 30 towards its lowered position urges the separating apparatus 12 against the support 74 to firmly retain the separating apparatus 12 on the chassis 34.

To enable the separating apparatus to be subsequently removed from the vacuum cleaner 10 for emptying, the user depresses the catch release button 264 to move the outlet duct 30 to its raised position. The movement of the flange 294 of the outlet duct 30 away from the separating apparatus 12 allows the biasing force of the first helical spring 288 to urge the lower end 292 of the body 284 of the handle 280 away from the lower surface 290 of the recess 286 and thereby push the handle 280 towards its deployed position. As shown in FIG. 21, when the outlet duct 30 is in its raised position, the head 282 is sufficiently proud of the separating apparatus 12 to enable a user to grasp the head 282 of the handle 280 and pull the handle 280 in a generally upward direction so as to pull the base 18 of separating apparatus 12 from the spigot 84 of the support 74. A catch located on the lower end 292 of the body 284 of the handle 280 may engage a shoulder located on the cyclone pack to prevent the handle 280 from becoming fully withdrawn from the recess 286.

The handle 280 comprises a manually operable button 298 for actuating a mechanism for applying a downward pressure to the uppermost portion of the catch 96 to cause the catch 96 deform and disengage from the lip 98 located on the outer wall 16 of the outer bin 14. This enables the base 18 to move away from the outer wall 16 to allow dirt and dust that has been collected in the separating apparatus 12 to be emptied into a dustbin or other receptacle. The button 298 is positioned on the handle 280 so that the button 298 is both located beneath the outlet duct 30 when the outlet duct 30 is in its lowered position and facing the main body 22 of the rolling assembly 20.

The actuating mechanism comprises a lower push member 300, preferably in the form of a rod, slidably mounted on the outer wall 16 of the outer bin 14. The outer wall 16 of the outer bin 14 comprises a plurality of retaining members 302 for retaining the lower push member 300 on the outer bin 14, and which constrain the lower push member 300 to slide towards or away from the catch 96. The lower push member 300 comprises an upper end 304 located adjacent the second cyclonic separating unit of the separating apparatus 12, and a lower end 306 for engaging the catch 96. The lower push member 300 is not biased in any direction.

The actuating mechanism further comprises an upper push member 308, preferably also in the form of a rod, slidably located within a recess 310 located between the inner portion 284*a* and the outer portion 284*b* of the body 284 of the handle 280. The upper push member 308 comprises a lower body 312 having a lower end 314 for engaging the upper end 304 of the lower push member 300. The lower end 314 protrudes radially outward through an aperture formed in the outer wall of the second cyclonic separating unit. The upper push member 308 further comprises an upper body 316 connected to, and preferably integral with, the lower body 312, and which comprises an outer frame 318 extending about an arm 320. The arm 320 is pivotable relative to the lower body 312, and internally biased towards the inner portion 284*a* of the body 284 of the handle 280.

The manually operable button 298 is biased in a generally upward direction by a second resilient member. This resilient member is in the form of a second helical spring 322. The lower end of the second helical spring 322 engages the upper end 324 of the inner portion 284*a* of the body 284, whereas the upper end of the second helical spring 322 engages a lower surface of the button 298 to urge the button 298 upwardly so that the upper surface of the button 298 is substantially flush with the upper surface of the handle 280. The button 298 also comprises a downwardly extending portion 328 which extends into the recess 310 formed in the body 284 of the handle 280.

With particular reference to FIG. 19, when the handle 280 is in its retracted position the downwardly extending portion 328 of the button 298 is located between the inner portion 284*a* of the body 284 and the upper body 316 of the upper push member 308. This prevents the catch 96 from being urged away from the lip 98 by the lower push member 300 in the event that the button 298 is depressed when the handle 280 is in its retracted position. The downwardly extending portion 328 of the button 298 engages and urges the arm 320 of the upper push member 308 away from the inner portion 284*a* of the body 284. As the handle 280 moves towards its extended position, under the action of the second helical spring 322 the button 298 is forced to move with the handle 280, causing the downwardly extending portion 328 of the button 298 to slide upwardly relative to the upper push member 308 and move beyond the upper end of the arm 320 of the upper push member 308. This allows the arm 320 to move towards the inner portion 284*a* of the body 284 of the handle 280. As illustrated in FIG. 20, when the handle 280 is in its extended position the downwardly extending portion 328 of the button 298 is located above the arm 320.

To enable the collected dirt and dust to be emptied from the separating apparatus 280, the user removes the separating apparatus 12 from the vacuum cleaner 10. While holding the separating apparatus 12 by the handle 280, which is now in its extended position, the user depresses the button 298, which moves downwardly against the biasing force of the second helical spring 322 and abuts the upper end of the arm 320 of the upper push member 308. Continued downward movement of button 298 against the biasing force of the second helical spring 322 pushes the lower end 314 of the upper push member 308 against the upper end 304 of the lower push member 300. This in turn pushes the lower end 306 of the lower push member 300 against the catch 96. The downward pressure thus applied to the catch 96 causes the catch 96 to move away from the lip on the outer wall 16 of the outer bin 14, allowing the base 18 to drop away from the outer wall 16 so that dirt and dust collected within the separating apparatus 12 can be removed therefrom.

When the user releases pressure from the button 298, the second helical spring 322 returns the button 298 respectively to the positions illustrated in FIG. 20. As the lower push member 300 is not biased in any direction, the lower push member 300 and the upper push member 308 are not returned to the positions illustrated in FIGS. 13 and 20 until the base 18 is swung back to re-engage the catch 96 with the lip on the outer wall 16 of the outer bin 14, whereupon the catch 96 pushes the lower push member 300 back to the position illustrated in FIGS. 13 and 20.

The invention is not limited to the detailed description given above. Variations will be apparent to the person skilled in the art.

The invention claimed is:

1. A canister vacuum cleaner comprising a floor engaging rolling assembly, a separating apparatus located in front of the rolling assembly for separating dirt from a dirt-bearing fluid flow, a motor-driven fan unit for drawing the fluid flow into the separating apparatus, a coupling for connection to a hose and wand assembly for conveying the dirt-bearing fluid flow to the separating apparatus, and a steering mechanism for steering the vacuum cleaner as it is maneuvered over a floor surface and for effecting relative pivotal movement between the separating apparatus and the rolling assembly about a pivot axis, wherein the rolling assembly comprises two wheels and the motor driven fan unit is located between the two wheels.

2. The vacuum cleaner of claim 1, wherein the separating apparatus comprises a handle to facilitate removal of the separating apparatus from the vacuum cleaner, and the handle is moveable between a stowed position and a deployed position.

3. The vacuum cleaner of claim 1, wherein the separating apparatus comprises a wall and a base member, the base member being held in a closed position by a catch and being pivotably connected to the wall.

4. The vacuum cleaner of claim 1, wherein the pivot axis is substantially vertical when the vacuum cleaner is located on a horizontal floor surface.

5. The vacuum cleaner of claim 1, wherein the separating apparatus is a cyclonic separating apparatus.

6. The vacuum cleaner of claim 1, wherein the steering mechanism comprises an inlet duct for conveying the fluid flow to the separating apparatus, and the inlet duct is moveable relative to the rolling assembly about the pivot axis.

7. The vacuum cleaner of claim 1, wherein the separating apparatus is moveable relative to the rolling assembly about an arc no greater than 90 degrees.

8. A canister vacuum cleaner comprising a floor engaging rolling assembly, a separating apparatus located in front of the rolling assembly for separating dirt from a dirt-bearing fluid flow, a motor-driven fan unit for drawing the fluid flow into the separating apparatus, a coupling for connection to a hose and wand assembly for conveying the dirt-bearing fluid flow to the separating apparatus, and a mechanism for effecting relative pivotal movement between the separating apparatus and the rolling assembly about a pivot axis, wherein the rolling assembly comprises two wheels and the motor-driven fan unit is located between the two wheels.

9. The vacuum cleaner of claim 8, wherein the pivot axis is substantially vertical when the vacuum cleaner is located on a horizontal floor surface.

10. The vacuum cleaner of claim 8, wherein the separating apparatus comprises a wall and a base member, the base member being held in a closed position by a catch and being pivotably connected to the wall.

11. The vacuum cleaner of claim 8, wherein the separating apparatus comprises a handle to facilitate removal of the separating apparatus from the vacuum cleaner, and the handle is moveable between a stowed position and a deployed position.

12. The vacuum cleaner of claim 8, wherein the separating apparatus is a cyclonic separating apparatus.

13. The vacuum cleaner of claim 8, wherein the mechanism comprises an inlet duct for conveying the fluid flow to the separating apparatus, and the inlet duct is moveable relative to the rolling assembly about the pivot axis.

14. The vacuum cleaner of claim 8, wherein the separating apparatus is moveable relative to the rolling assembly about an arc no greater than 90 degrees.

15. A canister vacuum cleaner comprising a floor engaging rolling assembly, a separating apparatus located in front of the rolling assembly for separating dirt from a dirt-bearing fluid flow, an inlet duct for conveying the fluid flow to the separating apparatus, a coupling provided at an end of the inlet duct for connection to a hose and wand assembly, and a steering mechanism for steering the vacuum cleaner as it is maneuvered over a floor surface and for effecting relative pivotal movement between the separating apparatus and the rolling assembly about a pivot axis, wherein the inlet duct is located at least partially beneath the separating apparatus.

16. The vacuum cleaner of claim 15, wherein the separating apparatus comprises a handle to facilitate removal of the separating apparatus from the vacuum cleaner, and the handle is moveable between a stowed position and a deployed position.

17. The vacuum cleaner of claim 15, wherein the separating apparatus comprises a wall and a base member, the base member being held in a closed position by a catch and being pivotably connected to the wall.

18. The vacuum cleaner of claim 15, wherein the pivot axis is substantially vertical when the vacuum cleaner is located on a horizontal floor surface.

19. The vacuum cleaner of claim 15, wherein the separating apparatus is a cyclonic separating apparatus.

20. The vacuum cleaner of claim 15, wherein the inlet duct is moveable relative to the rolling assembly about the pivot axis.

21. The vacuum cleaner of claim 15, wherein the vacuum cleaner comprises a motor-driven fan unit for drawing the fluid flow into the separating apparatus, the rolling assembly comprises two wheels, and the motor-driven fan unit is located between the two wheels.

22. The vacuum cleaner of claim 15, wherein the separating apparatus is moveable relative to the rolling assembly about an arc no greater than 90 degrees.

23. A canister vacuum cleaner comprising a floor engaging rolling assembly, a separating apparatus located in front of the rolling assembly for separating dirt from a dirt-bearing fluid flow, an inlet duct for conveying the fluid flow to the separating apparatus, a coupling provided at an end of the inlet duct for connection to a hose and wand assembly, and a mechanism for effecting relative pivotal movement between the separating apparatus and the rolling assembly about a pivot axis, wherein the inlet duct is located at least partially beneath the separating apparatus.

24. The vacuum cleaner of claim 23, wherein the separating apparatus comprises a handle to facilitate removal of the separating apparatus from the vacuum cleaner, and the handle is moveable between a stowed position and a deployed position.

25. The vacuum cleaner of claim 23, wherein the separating apparatus comprises a wall and a base member, the base member being held in a closed position by a catch and being pivotably connected to the wall.

26. The vacuum cleaner of claim 23, wherein the pivot axis is substantially vertical when the vacuum cleaner is located on a horizontal floor surface.

27. The vacuum cleaner of claim 23, wherein the separating apparatus is a cyclonic separating apparatus.

28. The vacuum cleaner of claim 23, wherein the inlet duct is moveable relative to the rolling assembly about the pivot axis.

29. The vacuum cleaner of claim 23, wherein the vacuum cleaner comprises a motor-driven fan unit for drawing the fluid flow into the separating apparatus, the rolling assembly comprises two wheels, and the motor-driven fan unit is located between the two wheels.

30. The vacuum cleaner of claim 23, wherein the separating apparatus is moveable relative to the rolling assembly about an arc no greater than 90 degrees.

* * * * *